US008950509B2

(12) United States Patent
Coffey et al.

(10) Patent No.: US 8,950,509 B2
(45) Date of Patent: Feb. 10, 2015

(54) FIRING ASSEMBLY FOR A PERFORATING GUN

(75) Inventors: Nathan Brian Coffey, Calgary (CA); Terry Lee Mytopher, Grand Prairie (CA)

(73) Assignee: Nine Energy Canada Inc., Calgary, Alberta (CA)

( * ) Notice: Subject to any disclaimer, the term of this patent is extended or adjusted under 35 U.S.C. 154(b) by 654 days.

(21) Appl. No.: 13/136,085

(22) Filed: Jul. 22, 2011

(65) Prior Publication Data

US 2012/0024528 A1 Feb. 2, 2012

Related U.S. Application Data

(63) Continuation-in-part of application No. 12/804,517, filed on Jul. 23, 2010, now Pat. No. 8,622,132.

(60) Provisional application No. 61/228,460, filed on Jul. 24, 2009, provisional application No. 61/230,468, filed on Jul. 31, 2009.

(51) Int. Cl.
*E21B 43/1185* (2006.01)

(52) U.S. Cl.
CPC ..... *E21B 43/11852* (2013.01)
USPC ..... 175/4.53; 175/4.56; 166/55

(58) Field of Classification Search
USPC ..... 166/297, 55; 175/4.53, 4.56, 4.58
See application file for complete search history.

(56) References Cited

U.S. PATENT DOCUMENTS

| | | | | |
|---|---|---|---|---|
| 2,980,017 A | | 7/1953 | Castel | |
| 3,329,218 A | | 7/1967 | Bell | |
| 4,299,287 A | | 11/1981 | Vann | |
| 4,756,371 A | | 7/1988 | Brieger | |
| 4,794,990 A | | 1/1989 | Riggs | |
| 4,886,126 A | * | 12/1989 | Yates, Jr. | 175/4.54 |
| 4,969,525 A | | 11/1990 | George | |
| 5,078,210 A | * | 1/1992 | George | 166/55 |

(Continued)

FOREIGN PATENT DOCUMENTS

| | | |
|---|---|---|
| CN | 201187287 | 1/2009 |
| RU | 2185498 | 7/2002 |

OTHER PUBLICATIONS

International Search Report for Patent Application No. PCT/IB2010/002163, dated Jan. 13, 2011 (8 pages).

*Primary Examiner* — Robert E Fuller
(74) *Attorney, Agent, or Firm* — Vinson & Elkins LLP

(57) ABSTRACT

A firing assembly is configured to be contained in a recess formed in a wall of a tubular string subassembly and operates without blockage of the central core of the casing subassembly. The assembly can include: one or more casings connected together to form a firing head containment body, the firing head containment body comprising a detonation chamber and actuation chamber; a detonator configured in the detonation chamber; a moveable actuator configured in the actuation chamber and operatively connected to the detonator, wherein the actuator is retained in a first position in the actuation chamber by a retention detent; a coupler operatively connected to the actuator opposite the detonator, wherein the coupler comprises a channel for communicating pressure through the coupler to the actuator that overcomes the retention detent and allows the actuator to move in the actuation chamber to as second position, wherein the detonator activates in dependence upon the actuator moving to the second position.

10 Claims, 13 Drawing Sheets

(56) References Cited

U.S. PATENT DOCUMENTS

| | | | | |
|---|---|---|---|---|
| 5,449,039 | A | 9/1995 | Hartley | |
| 5,660,232 | A | 8/1997 | Reinhardt | |
| 5,680,905 | A * | 10/1997 | Green et al. | 175/4.54 |
| 6,009,947 | A | 1/2000 | Wilson | |
| 6,220,355 | B1 | 4/2001 | French | |
| 6,386,288 | B1 | 5/2002 | Snider | |
| 6,394,184 | B2 | 5/2002 | Tolman | |
| 6,536,524 | B1 | 3/2003 | Snider | |
| 6,557,636 | B2 | 5/2003 | Cernocky | |
| 6,672,405 | B2 | 1/2004 | Tolman | |
| 6,761,219 | B2 | 7/2004 | Snider | |
| 6,962,202 | B2 | 11/2005 | Bell | |
| 7,152,676 | B2 | 12/2006 | Vella | |
| 7,461,580 | B2 | 12/2008 | Bell | |
| 7,621,342 | B2 | 11/2009 | Walker | |
| 8,151,882 | B2 | 4/2012 | Grigar | |

* cited by examiner 100
102
FIRST ROW
110
104

100
102
V
VI
VII
VII
VI
V
104
THIRD ROW 100
102
110
THIRD ROW
104
SECOND ROW 100
102
110
104
SECOND ROW
FIRST ROW

60°

FIRING ASSEMBLY FOR A PERFORATING GUN

PRIORITY AND CROSS REFERENCE TO RELATED APPLICATIONS

This application is a continuation-in-part and claims the benefit of Non-Provisional application Ser. No. 12/804,517, filed Jul. 23, 2010, entitled "Wellbore Subassembly With A Perforating Gun," which is incorporated herein by reference in its entirety. The Non-Provisional application Ser. No. 12/804,517, filed Jul. 23, 2010, in turn is related to and claims the benefit of Provisional Application No. 61/228,460, filed Jul. 24, 2009, and Provisional Application No. 61/230,468, filed Jul. 31, 2009, both entitled "Downhole Sub with Perforating Gun," which are incorporated herein by reference in their entirety through Non-Provisional application Ser. No. 12/804,517.

TECHNICAL FIELD

The present disclosure relates to the field of wellbore subassemblies with perforating guns. Particularly, the present disclosure relates to a firing assembly for use with wellbore subassemblies with perforating guns.

A wellbore generally refers to a hole drilled into the earth for the extraction of hydrocarbon-based materials such as, for example, oil and natural gas. Because the term "wellbore" generally includes the open hole or uncased portion of a well, the term "wellbore" typically refers to the space bounded by the wellbore wall—that is, the face of the geological formation that bounds the drilled hole. A wellbore is sometimes referred to as a "borehole."

A perforation is the communication tunnel created from the casing or liner into the reservoir formation, through which oil or gas is produced. The most common method of perforating uses jet-perforating guns equipped with shaped explosive charges. However, other perforating methods include bullet perforating, abrasive jetting or high-pressure fluid jetting. Perforation density is the number of perforations per linear foot. The term perforation density is used to describe the configuration of perforating guns or the placement of perforations, and is often abbreviated to "spf" (shots per foot). An example would be an 8 spf perforating gun. Perforation penetration is a measure, or indicator, of the length that a useable perforation tunnel extends beyond the casing or liner into the reservoir formation. In most cases, a high penetration is desirable to enable access to that part of the formation that has not been damaged by the drilling or completion processes. Perforation phasing is the radial distribution of successive perforating charges around the gun axis. Perforating gun assemblies are commonly available in 0-, 180-, 120-, 90- and 60-degree phasing. The 0-degree phasing is generally used only in small outside-diameter guns, while 60, 90 and 120 degree phase guns are generally larger but provide more efficient flow characteristics near the wellbore.

A perforating gun is a device used to perforate oil and gas wells in preparation for well production. Such guns typically contain several shaped explosive charges and are available in a range of sizes and configurations. The diameter of the gun used is typically determined by the presence of wellbore restrictions or limitations imposed by the surface equipment. The perforating gun, fitted with shaped charges or bullets, is lowered to the desired depth in a well and fired to create penetrating holes in casing, cement, and formation. Thus, to perforate is to pierce the casing wall and cement of a wellbore to provide holes through which formation fluids may enter or to provide holes in the casing so that materials may be introduced into the annulus between the casing and the wall of the borehole.

Current drilling has focused more on directional drilling. Directional drilling results in the creation of lateral well bores. Lateral well bores create many difficulties including difficulties with respect to perforating. It is appreciated that arcuate and lateral portions of a well bore create specific problems, especially with respect to perforating. Further, the longer the lateral portions of the well bore, the more difficult it is to achieve effective perforations. Thus, as drilling practices are directed more toward directional drilling, and directional drilling creates more and longer lateral well bores, the need for effective perforating techniques is greatly increased. The need for effective perforating techniques has long existed and the need increases proportionately with the increase in directional drilling.

There has been a long felt need to perforate accurately and efficiently. The types of charges available have restricted such perforating. The available charges are a restriction to enhancing the performance of the perforation. The characteristics of the perforation have been and continue to be inferior. Particularly, the need for a continuous, normal perforation, free from disruption, has long been sought after, but not achieved. Further, the ability to enhance the performance of the perforation has long eluded the art. Especially, the ability to assist and aid the existing charges in the enhancement of the capacity and forcefulness of the perforation has long been desired.

Current perforating devices adapted during casing installation are also problematic. Such perforating devices require secondary control lines that extend to the surface, and are tedious to install and use. It is long desired to have a "disappearing" perforating gun that is unobtrusive after it has been used.

In addition to the problems currently surrounding conventional perforating techniques, today's perforating practices require a great deal of equipment and manpower. For example, the use of coil tubing to initiate the perforating process is costly, time consuming, laden with the need for manpower, and prone to have safety problems.

Notwithstanding the above challenges in the field of wellbore perforation, a significant problem posed in conventional practice is the safety concerns that surround the transportation of a perforating gun to the wellbore site and the associated delays in assembly preparing the device to be conveyed downhole. In conventional systems, perforating charges and the detonators for activating those charges are not installed in a perforating gun prior to arrival at the surface site of the well because of the risk of accidental detonation during transport. The process of assembling the charges and detonator in the wellbore subassembly at the surface site is time consuming and costly because equipment and well services are often billed according to the amount of time that equipment was used or the services were performed at the well. Delays associated with assembling conventional detonators in conventional perforating guns may therefore be costly. It is long desired, therefore, to have a detonator that allows for faster, more efficient assembly in a perforating gun of a wellbore subassembly at the well site.

BRIEF DESCRIPTION OF THE DRAWINGS

The accompanying drawings, which are incorporated in and constitute a part of this specification, illustrate an implementation of apparatus consistent with the present disclosure and, together with the detailed description, serve to explain advantages and principles consistent with the disclosure. In the drawings, FIG. 1A sets forth a drawing illustrating a cross-sectional view of a firing assembly for detonating charges of a perforating gun according to embodiments of the present disclosure.

The above general description and the following detailed description are merely illustrative of the generic apparatus and method, and additional modes, advantages, and particulars will be readily suggested to those skilled in the art without departing from the spirit and scope of the disclosure.

DESCRIPTION OF EMBODIMENTS

Figure 1A:
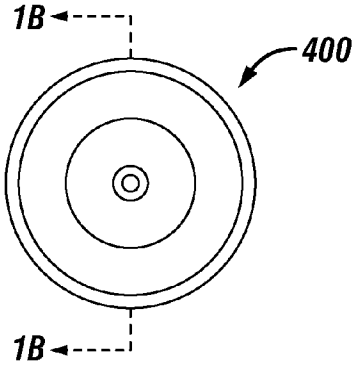
FIG. 1B sets forth a drawing illustrating the J-J sectional view as illustrated in FIG. 1A of the firing assembly.
Figure 1B:
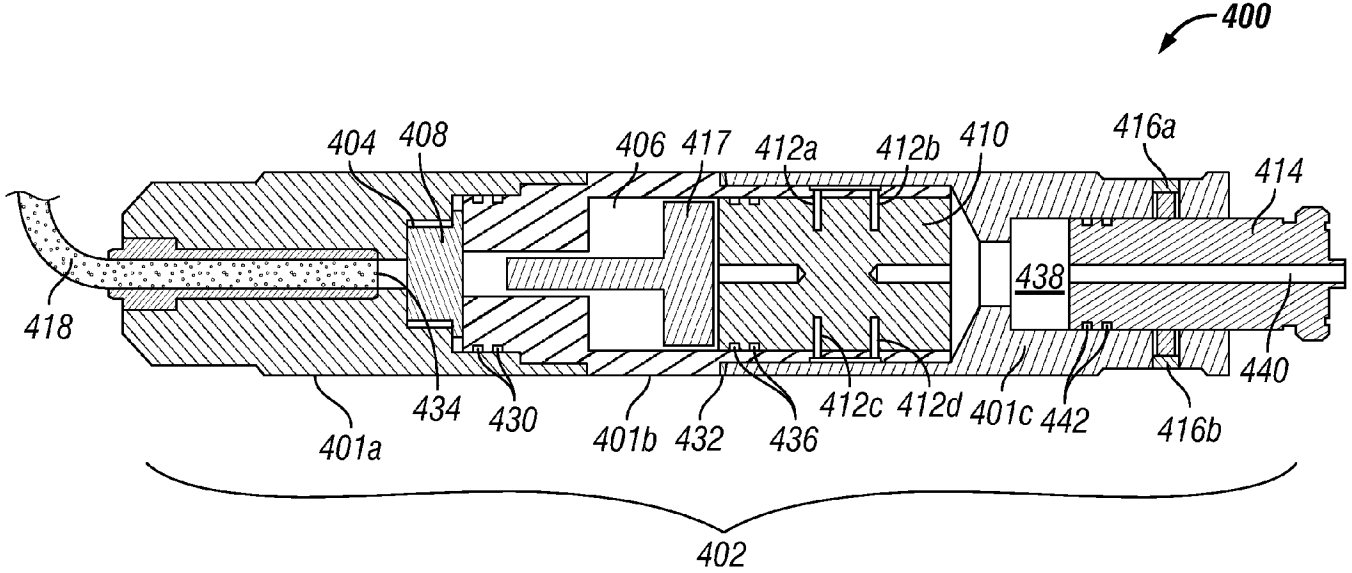

Exemplary embodiments of a firing assembly for detonating charges of a perforating gun are described herein with reference to the accompanying drawings, beginning with FIG. 1A. FIG. 1A sets forth a drawing illustrating a cross sectional view of a firing assembly for detonating charges of a perforating gun according to embodiments of the present disclosure. FIG. 1B sets forth a drawing illustrating the J-J sectional view of a firing assembly as illustrated in FIG. 1A. A perforating gun is a device used to perforate oil and gas wells in preparation for well production. Such guns are typically conveyed down a wellbore as part of a wellbore subassembly and contain several shaped explosive charges and are available in a range of sizes and configurations. The diameter of the gun used is typically determined by the presence of wellbore restrictions or limitations imposed by the surface equipment.

A wellbore generally refers to a hole drilled into the earth for the extraction of hydrocarbon-based materials such as, for example, oil and natural gas. Because the term "wellbore" generally includes the open hole or uncased portion of a well, the term "wellbore" typically refers to the space bounded by the wellbore wall—that is, the face of the geological formation that bounds the drilled hole. A wellbore is sometimes referred to as a "borehole."

A wellbore subassembly is a device that may be conveyed along a tubular string through a wellbore and used to perforate a geological formation adjacent to the wellbore at the location of the wellbore subassembly. The tubular string on which the wellbore subassembly is conveyed may be a casing string, a liner, a coiled tubing string, or any other tubular structure conveyed through a wellbore as will occur to those of skill in the art. The purpose of perforating the geological formation is to create fractures that assist in increasing the communication conductivity of hydrocarbon-based materials from the geological formation to the wellbore and then in turn to the surface.

The firing assembly (400) of FIG. 1B is used to activate the explosive charges that perforate the geological formation. In the example of FIG. 1B, the firing assembly (400) includes one or more casings (401) connected together to form a firing head containment body (402). The casings (401) in the example shown in FIG. 1B are cylindrical in nature and may be formed from metal such as steel, carbon-based materials, or other harden materials capable of withstanding explosive forces. The firing head containment body (402) includes the detonation chamber (404) and actuation chamber (406). That is, the casings (401) of FIG. 1B connect together to form hollowed regions within the firing head containment body (402) that form these chambers (404, 406) inside the body (402). These chambers (404, 406) may be connected and thus together form a single larger chamber, or each chamber (404, 406) may be physically separated from one another.

In the example of FIG. 1B, the firing head containment body (402) is composed of three casings (401*a*, 401*b*, 401*c*). The firing head containment body (402) of FIG. 1B is composed of multiple casings for, among others, manufacturing purposes. That is, milling out the chambers inside the firing head containment body (402) is easier and more cost effective when the firing head containment body (402) is divided into multiple casings. Dividing the firing head containment bodies (401) permits easier or efficient means of milling out the chambers (406) and (404) in the firing head containment body (402). It can be appreciated that the firing head containment body (402) can be a single structure or more than one structure.

The interface between casings (401) of FIG. 1B is typically implemented using screw threads. That is, the interface between the casing (401*a*) and another casing (401*b*) is a screw thread. Similarly, the casing (401*b*) and the other casing (401*c*) screw together to form a portion of the firing head containment body (402). The interfaces between casings (401) are sealed using gaskets such as, for example, O-rings. In the example of FIG. 1B, the interface between one casing (401*a*) and another casing (401*b*) is sealed using O-rings (430). Similarly, the interface between the middle casings (401*b*) and the end casing (401*c*) are sealed using O-rings (432).

In the example of FIG. 1B, the firing assembly (400) includes a detonator (408) configured in the detonation chamber (404). The detonator (408) of FIG. 1B is configured in the detonator chamber (404) prior to the mating together of a first distal casing (401*a*) and an intermediate casing (401*b*). After the first distal casing (401*a*) and the intermediate casing (401*b*) are sealed together, the detonator (408) is fixed in position in the detonation chamber (404). In the example of FIG. 1B, the detonator (408) is configured in the detonation chamber (404) adjacent to a channel (434) that receives a detonation cord (418). Upon activating the detonator (408), the explosion ignites the detonation cord (418) in the example of FIG. 1B. The detonation cord (418) of FIG. 1B is connected to perforating charges configured in the tubular wall of a wellbore subassembly as discussed further below.

The detonator (408) shown in FIG. 1B is a device used to trigger another explosive device. Detonators can be chemically, mechanically, or electrically initiated. However, mechanical and electrical ignition is the most common. In the example of FIG. 1B, the detonator (408) is implemented as a blasting cap. The blasting cap is a small sensitive primary explosive device generally used to detonate larger more powerful or less sensitive secondary explosives such as, for example, Trinitrotoluene ("TNT"), dynamite plastic explosives, or in the case of FIG. 1B—the detonation cord (418). In the example of FIG. 1B, the detonator (408) is activated when the firing pin (417) strikes the detonator (408) as discussed further below.

In the example of FIG. 1B, the firing assembly (400) also includes a movable actuator (410). The movable actuator (410) of FIG. 1B is configured in the actuation chamber (406) and operatively connected to the detonator (408). The operative connection in FIG. 1B includes the firing pin (417). In the example of FIG. 1B, the movable actuator (410) is a piston capable of moving horizontally back and forth through the actuation chamber (406). The movable actuator (410) interfaces with the wall of the actuation chamber (406) to slide along the actuation chamber (406). In the example of FIG. 1B, there is a seal between the movable actuator (410) and the wall of the actuation chamber (406) in the form of O-rings (436).

In the example of FIG. 1B, the movable actuator (410) is retained in a first position in the actuation chamber (406) by retention detents (412). In the example of FIG. 1B, the retention detents (412) are implemented as shearing pins that shear when a force impressed on the movable actuator reaches a predetermined threshold. That is, the retention detents (412), implemented as shear pins, shear to allow the movable actuator (410) to slide to the left in FIG. 1B when the force on the movable actuator (410) from the right of FIG. 1B reaches a predetermined threshold. As the movable actuator (410) moves through the actuation chamber (406), the firing pin (417) moves as well until the firing pin (417) strikes the detonator (408). That is, the detonator (408) of FIG. 1B activates in dependence upon the actuator (410) moving from the first position where it is retained by detents (412) to a second position which pushes the firing pin (417) into the detonator (408).

The predetermined threshold at which the detents (412*a*, 412*b*, 412*c*, 412*d*) of FIG. 1B shear may be selected based on the relative range of pressures in the actuation chamber (406) and the pressure chamber (438). Typically, the pressure in the actuation chamber (406) is set when the firing head containment body (402) is assembled and often the pressure is merely the atmospheric pressure of the environment in which such assembly occurred. The pressure in the pressure chamber (438) may initially be the atmospheric pressure of the environment in which the firing assembly (400) is inserted into a wellbore subassembly. In certain embodiments, however, the pressure in the pressure chamber (438) will increase when pressure from inside a wellbore subassembly is communicated to the pressure chamber (438) upon the rupturing of a burst disc as discussed in detail below. In other embodiments, the pressure in the pressure chamber (438) may be increased by releasing pressure from a pressure storage canister embedded in the wall of the firing head containment body (402). Such a pressure storage canister may be set to release storedup pressure into the pressure chamber (438) using an electrical activation signal received from a well operator at the surface of the well.

In the example of FIG. 1B, the firing assembly (400) includes a coupler (414). The coupler (414) of FIG. 1B is operatively connected to the movable actuator (410) opposite the detonator (408). That is, in the example of FIG. 1B, the coupler (414) is configured to the right of the actuator (410), while the detonator (408) is configured to the left of the actuator (410). The operative coupling between the coupler (414) and the actuator (410) includes the end casing (401*c*)—that is, the firing head containment body (401)—and the pressure chamber (438).

In the example of FIG. 1B, the coupler (414) includes a channel (440) for communicating pressure through the coupler (414) into the pressure chamber (438) and to the movable actuator (410). The pressure communicated through the coupler (414) produces a force directed toward the right wall of the movable actuator (410) that pushes the actuator (410) toward the detonator (408). The force created by the pressure communicated to the coupler (414) does not, however, move the actuator (410) until the force overcomes the retention detent (412). That is, in the example of FIG. 1B, as pressure builds inside the pressure chamber (438), the force against the moveable actuator (410) increases on the actuator (410) until it reaches a predetermined threshold that overcomes the shear resistance of the retention detents (412). When the force reaches the predetermined threshold and overcomes the retention detents (412), the movable actuator (410) shifts to the left in FIG. 1B forcing the firing pin (417) to strike the detonator (408), thereby igniting the detonation cord (418).

In the example of FIG. 1B, the coupler (414) is configured inside the thing head containment body (402) and the remaining portion is configured outside of the firing head containment body (402). The movable coupler (414) is movable relative to the firing head containment body (402) and the moving the coupler (414) operates to adjust the length of the firing assembly (400). The interface between the firing head containment body (402) and the coupler (414) in the example of FIG. 1B includes a screw thread. Rotating the coupler (414) relative to firing head containment body (402) moves the coupler (414) further inside the firing head containment body (402) or outside the firing head containment body (402) depending on the direction of rotation. Although the interface between the firing head containment body (402) and the coupler (414) in the example of FIG. 1B is implemented using a screw thread, one skilled in the art will recognize that other interfaces may also be useful in a firing assembly according to embodiments of the present disclosure such as, for example, a tongue-and-groove slide interface or a ratchet slide interface.

The interface between the coupler (414) and firing head containment body (402) in the example of FIG. 1B is sealed using O-rings (442). In the example of FIG. 1B, rotating the coupler (414) relative to the firing head containment body (402) adjusts the entire length of the firing assembly (400). The position of the movable coupler (414) in the example of FIG. 1B is secured relative to the firing head containment body (402) using set screws (416). Once the movable coupler (414) is in the desired place relative to the firing head containment body (402) an operator may tighten the setscrew (416) to fix the movable coupler (414) in place. Although set screws are utilized in the example of FIG. 1B, readers of skill in the art will recognize that other mechanisms for securing a moveable coupler in a firing assembly according to embodiments of the present disclosure may also be useful such as, for example, a quick release clamp.

In the example of FIG. 1B, the movable coupler (414) is only partially contained within the firing head containment body (402). In other embodiments, a coupler useful in a firing assembly according to embodiments of the present disclosure may be entirely embedded within the firing head containment body (402). That is, such an exemplary coupler may be integrated into the firing head containment body (402). In those embodiments, the firing assembly (400) is not held in place by adjusting the length of the firing assembly (400), but rather other mechanisms for retaining the firing assembly in the wellbore subassembly wall may be used such as, for example, clamps, grips, or any other securing mechanism that will occur in the skill of the art.

Figure 2:
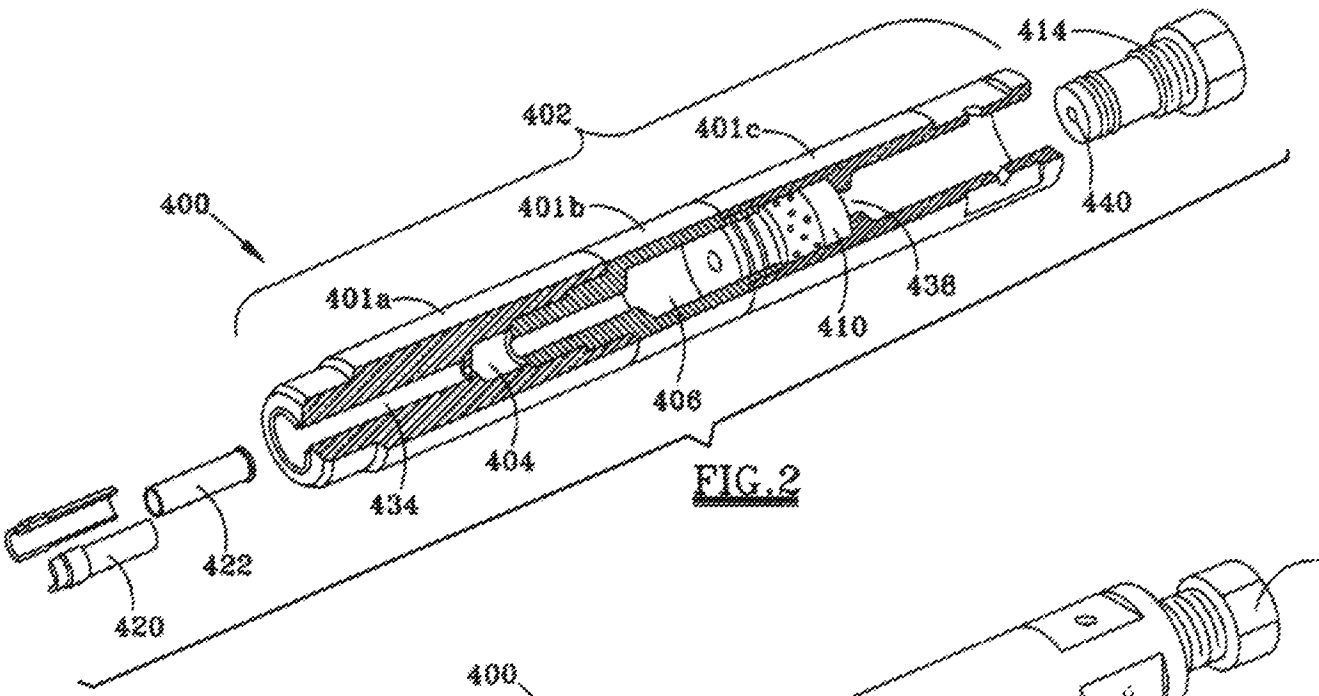
FIG. 2 sets forth a drawing illustrating an exploded, cutaway view of the firing assembly for detonating charges of a perforating gun according to embodiments of the present disclosure.

FIG. 2 sets forth a drawing illustrating an exploded, cutaway view of the firing assembly (400) for detonating charges of a perforating gun according to embodiments of the present disclosure. The firing assembly (400) of FIG. 2 is similar to the firing assembly depicted in FIG. 1. That is, the firing assembly (400) of FIG. 2 includes one or more casings (401*a*, 401*b*, 401*c*) connected together to form the firing head containment body (402). In the example of FIG. 2, the firing head containment body (402) is composed of three casings (401*a*, 401*b*, 401*c*).

The firing head containment body (402) includes a detonation chamber (404) and an actuation chamber (406). The detonation chamber (404) of FIG. 2 includes a detonator (not shown). The actuation chamber (406) includes a movable actuator (410) operatively connected to the detonator (not shown). The actuator (410) of FIG. 2 is retained in a first position in the actuation chamber (406) by one or more retention detents (not shown).

In the example of FIG. 2, the firing head assembly (404) includes a coupler (414) operatively connected to the actuator (410) opposite of the detonator (not shown) in the detonation chamber (404). The coupler (414) of FIG. 2 includes a channel (440) for communicating pressure through the coupler (414) and a pressure chamber (438) to the actuator (410) that overcomes the retention detents that hold the actuator (410) in a first position. When the retention detents are overcome by the force exerted on the actuator (410) by the pressure in the pressure chamber (438), the actuator (410) moves to a second position in the actuation chamber (406) towards the detonator.

As the actuator (410) moves towards the detonator in the example of FIG. 2, a firing pin (not shown) is pushed along by the actuator (410) and strikes the detonator. In this manner, the detonator activates incident upon the actuator (410) moving to the second position. Upon such activation, the detonator then ignites a detonation cord (not shown) that is received in the channel (434). The detonation cord is held in place in the channel (434) by friction as the detonation cord passes through the lead spacer (420) and the crimp tube (422). The crimp tube (422) helps prevent accidental ignition of the detonation cord from the forces exerted on the detonation cord by the lead spacer (420). In the example of FIG. 2, the detonator, the firing pin, and the detonation cord are omitted for clarity.

Figure 3:
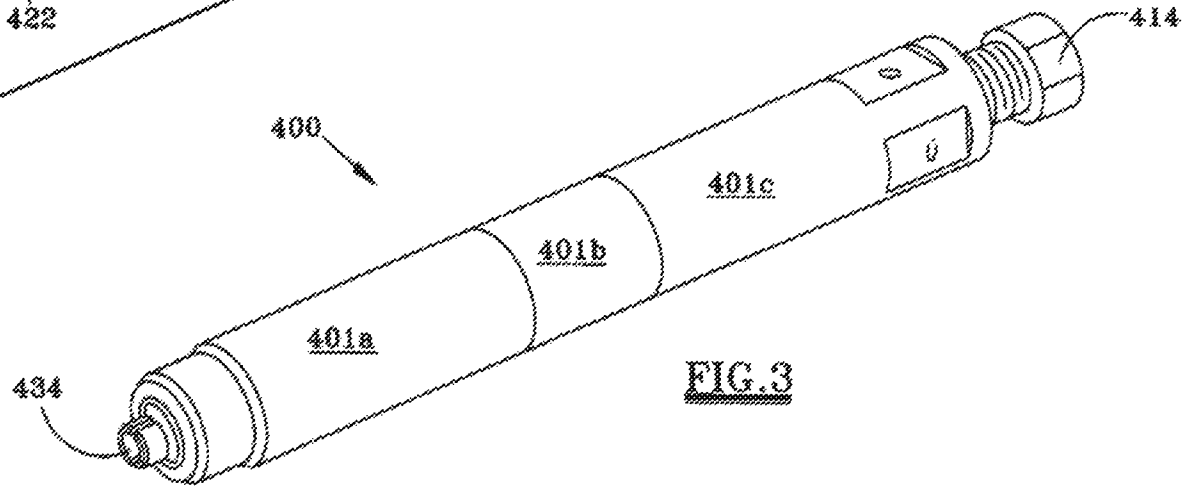
FIG. 3 sets forth a drawing illustrating a perspective view of the firing head assembly according to embodiments of the present disclosure that is fully assembled.

FIG. 3 sets forth a drawing illustrating a perspective view of the firing head assembly (400) that is fully assembled. The firing head assembly (400) of FIG. 3 is similar to the firing head assembly of FIGS. 1 and 2. The firing head assembly (400) of FIG. 3 includes a firing head containment body composed of three casings (401*a*, 401*b*, 401*c*). A detonation cord (not shown) is inserted into a channel (434) on the left end of the firing assembly (400) in the example of FIG. 3. The right end of the firing assembly (400) in the example of FIG. 3 has a coupler (414) that partially extends into the firing head containment body (402) with the remaining portion of coupler (414) extending outside the firing head containment body (402). Rotating the coupler (414) relative to the firing head containment body (402) of FIG. 3 adjusts the entire length of the firing assembly (400). The entire firing assembly (400) of FIG. 3 may then be configured in the wall of a wellbore subassembly to detonate the perforating charges embedded in the wellbore subassembly and secured in place by turning the coupler (414).

Figure 4:
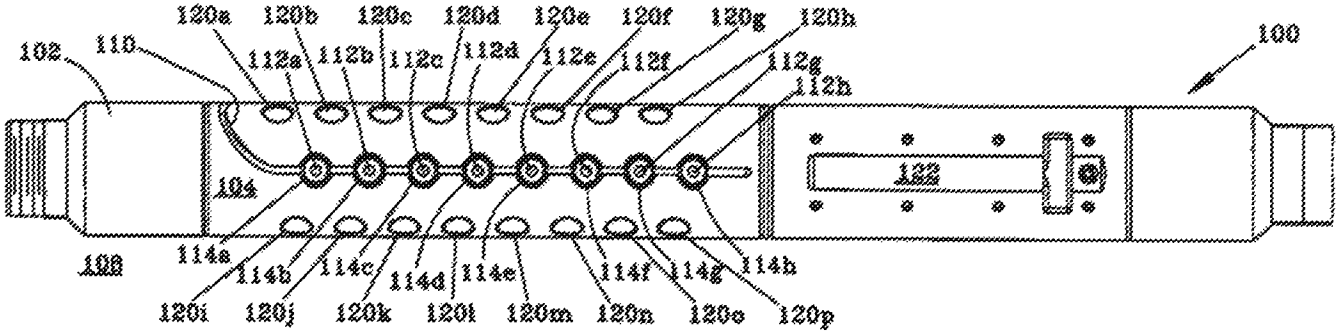
FIG. 4 sets forth a drawing illustrating a top plan view of a wellbore subassembly with perforating gun according to embodiments of the present disclosure.

Turning now to a wellbore subassembly having a firing assembly according to embodiments of the present disclosure, FIG. 4 sets forth a drawing illustrating a top plan view of a wellbore subassembly (100) with perforating gun according to embodiments of the present disclosure. The wellbore subassembly (100) of FIG. 4 is a device that may be conveyed along a tubular string through a wellbore and used to perforate a geological formation adjacent to the wellbore at the location of the wellbore subassembly (100). The tubular string on which the wellbore subassembly (100) of FIG. 4 is conveyed may be a casing string, a liner, a coiled tubing string, or any other tubular structure conveyed through a wellbore as will occur to those of skill in the art. The purpose of perforating the geological formation is to create fractures that assist in increasing the communication conductivity of hydrocarbon-based materials from the geological formation to the wellbore and then in turn to the surface.

The wellbore subassembly (100) of FIG. 4 includes a tubular body (102) having a tubular wall (104). The tubular wall (104) of the exemplary wellbore subassembly (100) in FIG. 4 separates and defines two spaces—an interior space (not shown) along the inside of the tubular body (102) and an exterior space (108) surrounding the outside of the tubular body (102). The tubular body (102) in the example of FIG. 4 is configured in a cylindrical shape because many wellbore components utilize this shape, but other shapes as will occur to those of skill in the art may also be useful. In the example of FIG. 4, the tubular body (102) is primarily designed out of a strong, but lightweight material, such as for example, aircraft aluminum. One skilled in the art, however, will recognized that other materials may also be useful in wellbore subassemblies according to embodiments of the present disclosure such as, for example, other types of aluminum, steel, carbon-based materials, and so on.

Because the wellbore subassembly (100) of FIG. 4 is typically configured as part of a tubular string, the interior space (not shown) of the wellbore subassembly (100) may be used to convey the variety of materials that typically pass through a tubular string during the lifecycle of a well. Such materials include, for example, water, treatment fluids, frac gels, hydrocarbons, or any other materials as will occur to those of skill in the art.

The exterior space (108) of FIG. 4 is the region surrounding the wellbore subassembly (100) and may include the adjacent geological formation. The exterior space (108) of FIG. 4 may also include any intervening structures between the wall (104) and the geological formation, including any additional tubular walls from strings through which the wellbore subassembly (100) is conveyed, any pockets of air or fluid in the annulus between the wall (104) and the geological formation. In many embodiments, the tubular string on which the wellbore subassembly (100) of FIG. 4 is conveyed is cemented in place. That is, cement fills the annulus between the wall (104) and the geological formation. In such embodiments, the exterior space (108) also includes this cement annulus and the adjacent geological formation.

In the example of FIG. 4, the tubular wall (104) has a cavity (110) for holding perforating charges (112) and a detonation cord (not shown). The detonation cord connects the charges (112) to a firing assembly (not shown, discussed below) that is installed in the firing assembly recess (122). The exemplary tubular body (102) of FIG. 4 includes only one cavity (110) and that cavity (110) is configured in an "S" pattern that runs longitudinally along the length of the tubular body (102). This "S" patterned cavity (110) in FIG. 4 is shaped to define three rows of charge sockets (114). In the view of FIG. 4, however, only one row of the charge sockets is visible—namely, the row of charge sockets (114*a-h*) in the center of FIG. 4.

Each charge socket (114) of FIG. 4 is cylindrical in shape slightly larger than the perforating charge (112) that will be configured inside the socket (114). Each socket (114) of FIG. 4 receives and holds only one perforating charge (112), and in this manner, each charge socket (114) isolates its corresponding perforating charge (112) from the other charges to minimize interference among the charges (112) as the charges (112) detonate. In the example of FIG. 4, the shape of the sockets (114) themselves also operate to minimize detonation interference among the charges (112) because walls of each socket (114) assist in channeling the explosive forces from each perforating charge (112) radially inward toward the center of the wellbore subassembly (100) rather than permitting the explosive forces to flow along the longitudinal length of the tubular body (102).

During the assembly of the wellbore subassembly (100) of FIG. 4, the perforating charges (112) are typically inserted into the charge sockets (114) and held in place by frictional forces, O-ring gaskets, or other ways as will occur to those skilled in the art. A detonation cord is then run from the firing assembly (discussed below) along the cavity (110) and across the top of the charges (112).

Although not shown in FIG. 4, the tubular wall (104) also includes a removable outer layer (not shown; discussed below) that fits around the portion of the tubular body (102) containing the perforating charges (112). This removable exterior sleeve covers the cavity (110) from the exterior space (108) and protects the charges (112) from conditions in the exterior space (108). In addition, the removable outer layer may also operate to keep the charges and detonation cord in place inside the cavity (110).

The wellbore subassembly (100) of FIG. 4 includes a plurality of perforating charges (112). Each perforating charge (112) of FIG. 4 is configured in the cavity (110) at a location inside that is within the wall (104). The perforating charges (112) of FIG. 4 are shaped charges that channel the explosive forces in the direction of the center of the tubular body (102). That is, the perforating charges (112) of FIG. 4 are configured to discharge toward the interior space (not shown) and penetrate into the exterior space (108) by perforating the wall (104) across the interior space from the location of the perforating charge (112) defined as the target wall. In this manner, each charge (112) discharges toward and into the interior space and out through the other side via the target wall of the wellbore subassembly (100) into the exterior space (108). This discharge configuration creates a straight path, free from irregularities and well defined, through the tubular wall (104) for communicating fluids, gases, or other materials between the interior space of the wellbore subassembly (100) and the exterior space (108).

In the example of FIG. 4, the wellbore subassembly (100) also includes exit cavities (120) designed to reduce the thickness of the wall (104) where the perforating charges (112) penetrate into the exterior space (108). The exit cavities (120) of FIG. 4 effectively thin the amount of the wall (104) that the charges (112) must perforate before penetrating into the exterior space (108) and allow more energy from the detonation to reach the exterior space (108). The use of the exit cavities (120) results in deeper penetrations into the adjacent geological formation. Each exit cavity (120) in the example of FIG. 4 corresponds to and is shaped similar to one of the charge sockets (114). Each exit cavity (120) of FIG. 4 is cylindrical in shape and is located in the wall (104) across the interior space from the location of its corresponding charge socket (114) and associated perforating charge (112). In FIG. 4, the exit cavities (120*a-h*) illustrated above the charge sockets (114) correspond to charges and charge sockets that are not visible from the view of FIG. 4 because those charges and charge sockets are on the opposite side of the wellbore subassembly (100). The exit cavities (120*i-p*) illustrated below the charge sockets (114) also correspond to charges and charge sockets that are not visible in FIG. 4. Similarly, while charges (112*a-h*) and charge sockets (114*a-h*) are visible in FIG. 4, the corresponding exit cavities are not visible because they are on the opposite side of the wellbore subassembly (100). One skilled in the art, however, will note that none of the charge sockets (114) or the exit cavities (120) would actually be visible from a mere outside inspection of the wellbore subassembly (100) because the portion of the tubular body (102) in FIG. 4 configured with the charge sockets (114) and exit cavities (120) includes a removable outer layer (118) that protects those features from the exterior space (108). It is also appreciated that the density of the material associated with the exit cavities and/or the target wall can be changed to provide and enhance perforation.

As mentioned above, the perforating charges (112) and the detonation cord (not shown), which are conveyed along the cavity (110), connect to a firing assembly (not shown) that is mounted in the firing assembly recess (122). The firing assembly recess (122) of FIG. 4 is implemented as a slot in the wall (104) oriented longitudinally along the tubular body (102). The firing assembly recess (122) of FIG. 4 is connected to the cavity (110) through a hollowed passage (not shown) in the wall (104). In FIG. 4, the firing assembly recess (122) is configured to receive a firing assembly oriented longitudinally along the tubular body (102). The firing assembly is secured in the firing assembly recess (122) of FIG. 4 using an exterior sleeve (not shown) that is described further with reference to FIGS. 15 and 16 below. In other embodiments, the firing assembly may be secured in the firing assembly recess (122) using clamps such as those clamps described further with reference to FIG. 16 below.

Figure 5:
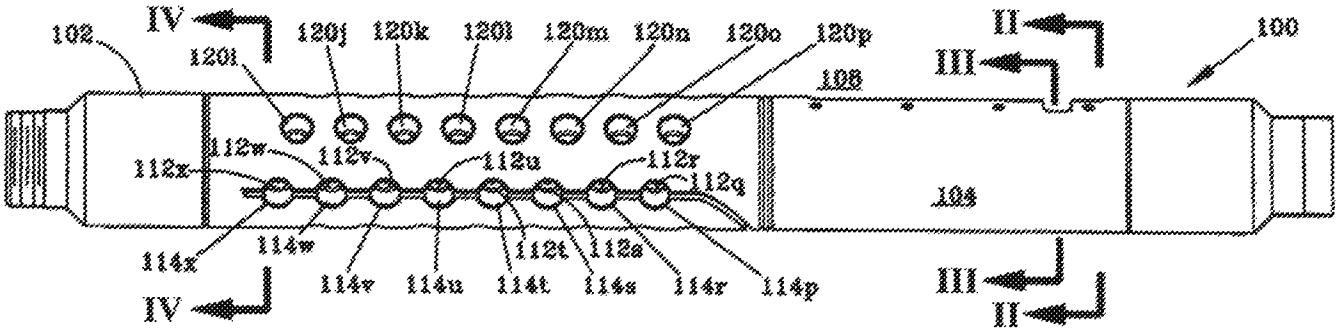
FIG. 5 sets forth a drawing illustrating a side elevation view of the wellbore subassembly with perforating gun according to embodiments of the present disclosure.

FIG. 5 sets forth a drawing illustrating an elevation view of the wellbore subassembly (100) with perforating gun according to embodiments of the present disclosure. The view of the wellbore subassembly (100) in FIG. 5 illustrates the third row of charge sockets (114*q-x*) configured in the cavity (110) and also illustrates exit cavities (120*i-p*). Each charge socket (114*q-x*) receives a single perforating charge (112) and corresponds with one of the exit cavities (120*a-h*) depicted in FIG. 4. For example, the charge socket (114*x*) corresponds with exit cavity (120*a*) from FIG. 4 because the perforating charge (112*x*) in the socket (114*x*) is directed to penetrate the wall (104) at the location of the exit cavity (120*a*) in FIG. 4 across the interior space of the tubular body (102).

Figure 6:
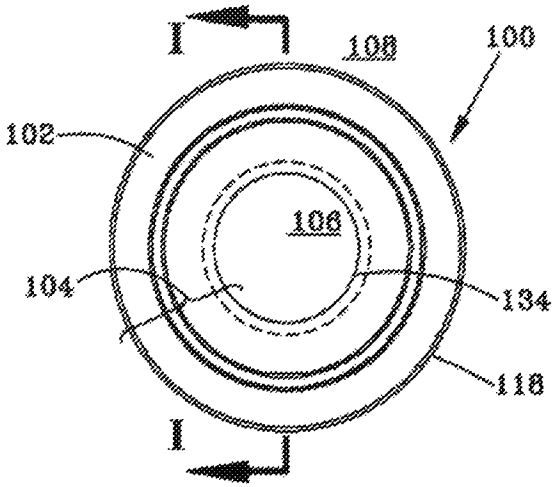
FIG. 6 sets forth a drawing illustrating a cross-sectional view of the wellbore subassembly with perforating gun according to embodiments of the present disclosure.

FIG. 6 sets forth a drawing illustrating a cross-sectional view of the wellbore subassembly (100) with perforating gun according to embodiments of the present disclosure. FIG. 6 depicts the tubular body (102) formed from a cylindrical wall (104). The wall of FIG. 6 defines an interior space (106) and an exterior space (108). In the example of FIG. 6, the tubular body (102) includes a removable outer layer (118) that covers the cavity (not shown) from the exterior space (108). The tubular body (102) of FIG. 6 also includes an inner liner (134) configured along the tubular body (102) between the sockets (not shown) of the cavity and the interior space (106). The inner liner (134) of FIG. 6 separates the charge sockets from the interior space (106).

Figure 7:
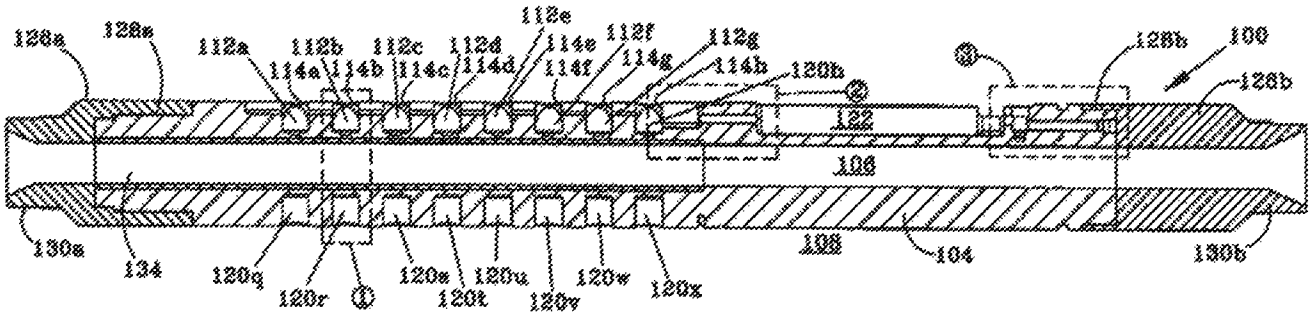
FIG. 7 sets forth a drawing illustrating the A-A sectional view from FIG. 6 of the wellbore subassembly with perforating gun according to embodiments of the present disclosure.

FIG. 7 sets forth a drawing illustrating the A-A sectional view of the wellbore subassembly (100) with perforating gun according to embodiments of the present disclosure from FIG. 6. The wellbore subassembly (100) of FIG. 7 includes a tubular body (102) that has a wall (104) defining an interior space (106) and an exterior space (108). The wall (104) of FIG. 7 has a cavity (110) that is shaped to define a plurality of charge sockets (114). The cavity (110) connects to the firing head recess (122) via a hollowed passage through the wall (104) of the tubular body (102). The manner in which the firing head assembly in the firing head recess (122) ignites the detonation cord, and in turn detonates the perforating charges, is discussed further below with reference to FIGS. 15 and 16.

Further, FIG. 7 illustrates the exit cavities (120) corresponding to the charge sockets (114). The exit cavity (120) can have therein or associated therewith an accelerator or performance enhancer to provide a cleaner perforation tunnel, as well as a longer, bigger and better defined fraction or perforation. The accelerator or performance enhancer can be any appropriate stimulator, such as for example, a jet fuel product. Further, the accelerator or performance enhancer can be in any form, such as for example, a solid, liquid, wax or combinations thereof. Such an accelerator or performance enhancer can be built into the exit cavity (120), can be placed in the exit cavity (120), or associated with the exit cavity (120) so as to provide a cleaner perforation tunnel, as well as a longer, bigger and better defined fraction or perforation.

In the example of FIG. 7, the tubular body (102) includes an inner liner (134). The inner liner (134) is configured longitudinally along the length of the tubular body (102) between the cavity (110) and the interior space (106). The inner liner (134) of FIG. 7 is cylindrical in shape and forms part of the wall (104) defining the interior space (106). The sides of the inner liner (134) in FIG. 7 may be generally flat, thereby making the cross-section of the sides of the inner liner (134) rectangular in shape. One skilled in the art, however, will recognize that the wall of the inner liner (134) may be formed in a variety of geometric configurations to enhance structural support along different areas of the tubular body (102).

In some embodiments, the cavity (110) may extend at various locations through the wall (104) to the inner liner (134) such as, for example, at the charge sockets (114). In such embodiments, when the perforating charge (112) first penetrates into the interior space (106), it need only pass through the inner liner (134). In other embodiments, however, the cavity (110) may not extend through the wall (104) all the way to the inner liner (134). In those embodiments, the perforating charge (112) must first penetrate through a portion of the wall material forming the cavity (110) as well as the inner liner (134) before reaching the interior space (106).

The inner liner (134) of FIG. 7 extends along the tubular body (102) at the portion of the tubular body (102) containing the perforating charges (112). One skilled in the art, however, will recognize that the inner liner (134) may extend along the entire length of the tubular body (102) or merely a portion of the tubular body (102). The inner liner (134) of FIG. 7 operates to reduce interference among the perforating charges (112) as the charges (112) detonate serially. This interference may occur because, as each charge (112) detonates, the pressure from the detonation may deform nearby charge sockets. Accordingly, any undetonated charges in those nearby sockets may not fire completely along the intended path directly through the interior space (106) and out of the other side of the wellbore subassembly (100). This misdirected detonation reduces the effectiveness of the charge (112) at penetrating into the exterior space (108). The inner liner (134) of FIG. 7 reduces the interference among the perforating charges (112) by reinforcing the charge sockets (114). The inner liner (134) of FIG. 7 is made of a harder material than the portion of the tubular body (102) forming the cavity (110). For example, the inner liner (134) of FIG. 7 may be made of a material such as steel. In contrast, the other portions of the tubular body (102) may be configured from aluminum or other materials that are relatively lightweight, but may become brittle and susceptible to deformation at high pressures such as may occur during a charge detonation. When the tubular body (102) is implemented entirely using a material, such as for example steel, which is not typically subject to the deformation that would diminish the effectiveness of the perforating charges (112), one skilled in the art will recognize that an inner liner may, or may not, provide any advantages.

The tubular body (102) in the example of FIG. 7 includes two interchangeable end adapters—an interchangeable end adapter (126*a*) on the left end of the tubular body (102) and an interchangeable end adapter (126*b*) on the right end of the tubular body (102). These interchangeable end adapters allow the wellbore subassembly (100) to be conveyed along tubular strings of varying sizes or that connect with the wellbore subassembly (100) using different types of interfaces such as, for example, different types of screw threads. Each interchangeable end adapter (126) has a first interface (128) for connecting to the other portions of the tubular body (102) and has a second interface (130) for connection to a tubular string along which the wellbore assembly (100) is conveyed. In the example of FIG. 7, the interchangeable end adapter (126*a*) on the left side of the tubular body (102) includes the first interface (128*a*) that is implemented using a screw thread that matches the screw thread of the portion of the tubular body (102) to which the interchangeable end adapter (126*a*) connects.

The second interface (130*a*) of the interchangeable end adapter (126*a*) in the example of FIG. 7 is also implemented using a screw thread. The screw thread of the second interface (130*a*) matches the screw thread of the next component in the tubular string along which the wellbore subassembly (100) is conveyed. The interchangeable end adapter (126*b*) on the right side of the tubular body (102) includes a first interface (128*b*). The first interface (128*b*) is implemented using a screw thread that matches the screw thread of the portion of the tubular body (102) to which the interchanged end adapter (126*b*) connects. The interchangeable end adapter (126*b*) of FIG. 7 also includes a second interface (130*b*) that is implemented using a screw thread that matches the screw thread of the next component of the tubular string along which the wellbore subassembly (100) is conveyed.

Figure 8:
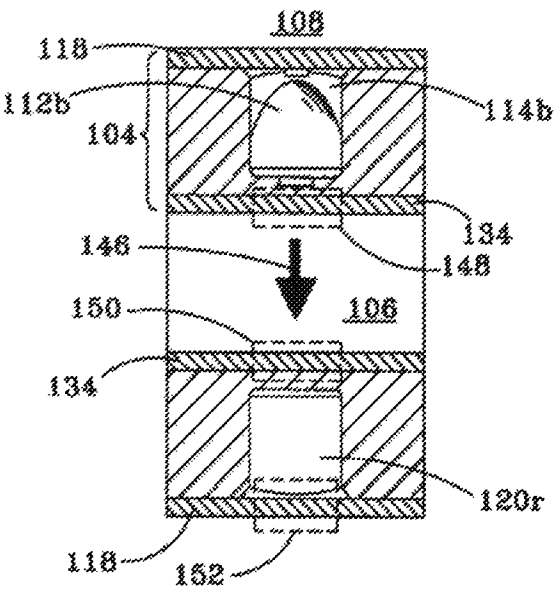
FIG. 8 sets forth a drawing illustrating a detailed view of region one (1) from FIG. 7 of the wellbore subassembly with perforating gun according to the embodiments of present disclosure.

FIG. 8 sets forth a drawing illustrating a detailed view of region one (1) of the wellbore subassembly (100) with perforating gun according to the embodiments of the present disclosure from FIG. 7. In the example of FIG. 8, the perforating charge (112*b*) is configured in charge socket (114*b*) at a location within the wall (104). At a location along the wall (104) across the interior space (106) from the location of the perforating charge (112*b*), the wall (104) is configured with an exit cavity (120*r*).

The perforating charge (112*b*) in the example of FIG. 8 is protected from the exterior space (108) by the removable outer layer (118). To protect the socket (114*b*) and the charge (112*b*) from deformation due to the pressure created in the interior space (106) from the other detonating charges in the wall (104), the wall (104) includes inner liner (134) made of a material, such as for example steel, that reinforces socket (114*b*) to withstand the forces created from the other detonating charges. In the example of FIG. 8, the perforating charge of (112*b*) is a shaped charge that detonates inwardly toward the interior space (106) and perforates the wall (104) at a location across the interior space (106) from the location of the perforating charge (112*b*) and penetrates into the exterior space (108). That is, in the example of FIG. 8, the perforating charge detonates along the direction of arrow (146). Upon detonation, therefore, the perforating charge (112*b*) penetrates the inner liner (134) at specific rupture regions (148, 150) and then continues through the wall (104) to penetrate the removable outer layer (118) at another rupture region (152). The intermediate rupture region (150) can be defined as the wall target.

Figure 9:
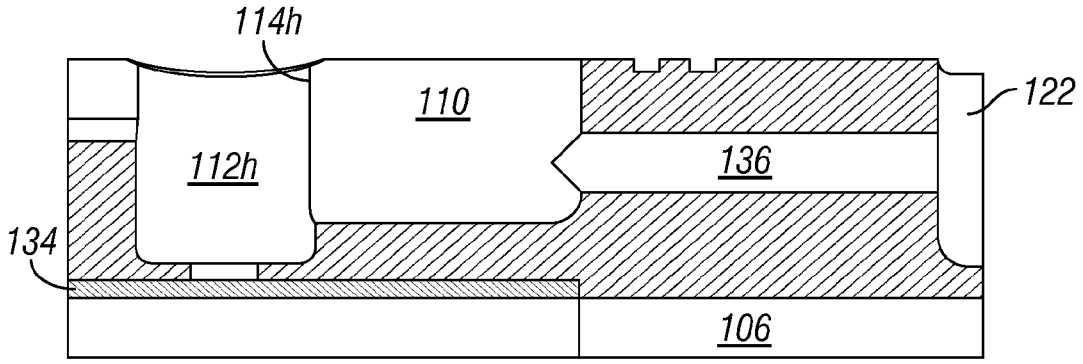
FIG. 9 sets forth a drawing illustrating a detailed view of region two (2) from FIG. 7 of the wellbore subassembly with perforating gun according to the embodiments of present disclosure.

As described above, perforating charges (112) in the wellbore subassembly (100) according to embodiments of the present disclosure are ignited via a detonation cord that connects to a firing head assembly in the firing head recess (122). For further explanation, therefore, FIG. 9 sets forth a drawing illustrating a detailed view of region two (2) from FIG. 7 of the wellbore subassembly (100) with perforating gun according to the embodiments of the present disclosure. In the example of FIG. 9, the cavity (110) is configured to form a charge socket (114*h*), and the perforating charge (112*h*) is seated in the socket (114*h*) of FIG. 9. A detonation cord (not shown) is extended across the top of the perforating charge (112*h*) along the cavity (110) and is configured through the hollowed passageway (136) to the firing assembly recess (122) where, the detonation cord connects to the firing head assembly (not shown). Further, FIG. 8 illustrates the exit cavities (120) corresponding to the charge sockets (114). The exit cavity (120) can have therein or associated therewith an accelerator or performance enhancer to provide a cleaner perforation tunnel, as well as a longer, bigger and better defined traction or perforation. The accelerator or performance enhancer can be any appropriate stimulator, such as for example, a jet fuel product. Further, the accelerator or performance enhancer can be in any form, such as for example, a solid, liquid, wax or combinations thereof. Such an accelerator or performance enhancer can be built into the exit cavity (120), can be placed in the exit cavity (120), or associated with the exit cavity (120) so as to provide a cleaner perforation tunnel, as well as a longer, bigger and better defined fracture or perforation, It has been found that the configuration of the charge socket (114), the interior space (106) and the exit cavity (120) creates a focused discharge that greatly enhances the resulting explosive characteristics. There is a volume of gas and air that expands when the charges (112) ignite. This natural expansion of gas and air provides additional explosive characteristics.

Further, it has been found that the structure and/or configuration of the charge socket (114) enhances the explosive characteristics associated with the present disclosure. The structure and/or configuration of the charge socket (114) confines the explosive charge characteristics thereby increasing the charge performance.

Figure 10:
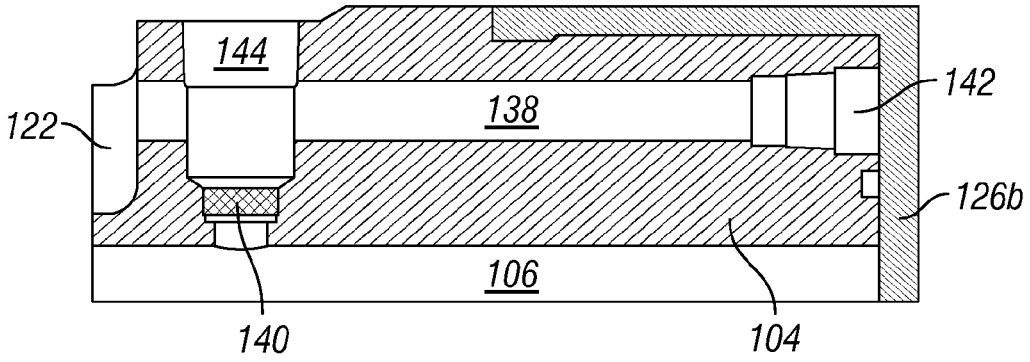
FIG. 10 sets forth a drawing illustrating a detailed view of region three (3) from FIG. 7 of the wellbore subassembly with perforating gun according to the embodiments of present disclosure.

For further explanation of the manner in which the firing head assembly is detonated, FIG. 10 sets forth a drawing illustrating a detailed view of region three (3) from FIG. 7 of the wellbore subassembly (100) with perforating gun according to the embodiments of present disclosure. The firing head assembly that is positioned in the firing recess (122) in the embodiment of FIG. 10 is actuated by fluid pressure in the interior space (106). The well operator at the surface of the well typically controls the fluid pressure in the interior space (106). Varying the pressure applied to the tubular string at the surface varies the pressure in the interior space (106) of the wellbore subassembly (100), which is a component of the tubular string.

In the embodiment of FIG. 10, the pressure of the interior space (106) is communicated to the firing head assembly in the firing assembly recess (122) through a hollowed passage (138) and through a burst disc (140). The burst disc (140) of FIG. 40 is designed as a pressure barrier between the interior space (106) and the hollowed passage (138). When the pressure differential between the interior space (106) and hollowed passage (138) exceeds a predetermined threshold, the burst disc (140) ruptures, thereby communicating the pressure of the interior space (106) into the hollowed passage (138) and then into the firing assembly in the firing assembly recess (122). The firing assembly in the firing assembly recess (122) then ignites the detonation cord, which in turn detonates the perforated charges in the charge sockets as the detonation cord burns through the cavity. In FIG. 10, the hollowed passage (138) extends through the wall (104) from the firing assembly recess (122) beyond the burst disc (140) to the interchangeable end adapter (126*b*). The portion of the hollowed passage (138) to the left of the burst disc (140) in FIG. 10 is used to communicate fluid pressure through interior space (106) to the firing assembly recess (122). The portion of the hollowed passage (138) to the right of the burst disc (140) in FIG. 10 is the result of machining the hollowed passage (138) through the wall (104). After the passage (138) is machined, a plug (142) is used to seal the passage (138) so that pressure from the interior space (106) is communicated to the firing assembly in recess (122). The portion of the hollowed passage (138) to the right of the burst disc (140) in FIG. 10 may not be present in embodiments where the passage (138) to the burst disc (140) is created by drilling from the firing assembly recess (122) on the left of FIG. 10.

The portion of the passage (138) of FIG. 10 that extends downward to the burst disc (140) from the top of the wall (104) may be created by machining a hole from the top of the wall (104) to the interior space (106). The top of the passage (138) is capped by a plug (144). The burst disc (140) of FIG. 10 rests in the bottom of the passage (138), thereby creating a barrier between the passage (138) and the interior space (106) until the burst disc (140) ruptures due to an increase in the pressure differential between the passage (138) and the interior space (106).

In the embodiment of FIGS. 7 through 10, the wellbore subassembly (100) detonates the perforating charges using a fluid pressure signal in the form of an increase in pressure through the tubular string, and in turn the interior space (106), sufficient to rupture the burst disc (140) and actuate the firing head assembly. In this manner, the burst disc (140) operates, as a hydraulic pressure valve that opens when the pressure differential reaches a certain predetermined threshold that is high enough to avoid accidental firing of the firing head assembly. Other structures and mechanisms for initiating detonation of the perforating charges as will occur to those of skill in the art may also be useful.

In other embodiments, an electrical conductor may be operatively connected to the firing assembly in the firing assembly recess (122). The electrical conductor may communicate an electrical signal from the surface to the firing assembly, which in turn initiates detonation of the perforating charges based on receipt of the signal.

In still other embodiments, the firing assembly may be operatively connected to a radio frequency receiver. The radio frequency receiver may receive a radio frequency signal originating from a well operator on the surface. In response to receiving the radio frequency signal, the radio frequency receiver may, in turn, transmit a detonation signal to the firing head assembly to initiate detonation of the perforating charges.

Fiber optic technology may also be useful for detonating the perforating charges, especially in formations where the magnetic characteristics of the formation reduce the reliability of the electric or radio frequency signaling. In such embodiments, the firing assembly may be operatively connected to a fiber optic receiver. The fiber optic receiver may receive a fiber optic signal originating from a well operator on the surface. In response to receiving the fiber optic signal, the fiber optic receiver may, in turn, transmit a detonation signal to the firing head assembly to initiate detonation of the perforating charges.

The embodiment of FIGS. 7-10 may utilize hydraulic pressure to initiate the detonation of the perforating charges. In other embodiments, however, pneumatic pressure values may be more appropriate. Such embodiments may operate similarly to the hydraulic version described with reference to FIGS. 7-10. One or more pneumatic pressure values may be actuated by a pneumatic pressure signal. The pneumatic pressure values may communicate pneumatic pressure to the firing assembly to initiate detonation of the perforating charge in response to the pneumatic pressure signal. For example, the pneumatic pressure signal may be implemented as a certain threshold level of pneumatic pressure or a certain sequence of particular pressure levels.

Figure 11:
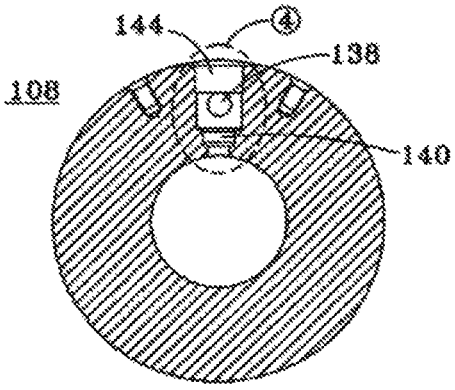
FIG. 11 sets forth a drawing illustrating a sectional view taken along the section line B-B from FIG. 5 of the wellbore subassembly with perforating gun according to the embodiments of the present disclosure.

For further explanation, FIG. 11 sets forth a drawing illustrating B-B sectional view from FIG. 5 of the wellbore subassembly (100) with perforating gun according to the embodiments of the present disclosure. FIG. 11 depicts the burst disc (140) that operates as a barrier between interior space (106) and the hollowed passage (138). As mentioned above, the hollowed passage (138) is formed to communicate fluid pressure from the interior space (106) to the firing assembly in the firing assembly recess. The burst disc (140) in the embodiment of FIG. 11 is configured at the bottom of the hollow passage (138) and is capped off from the exterior space (108) using plug (144).

Figure 12:
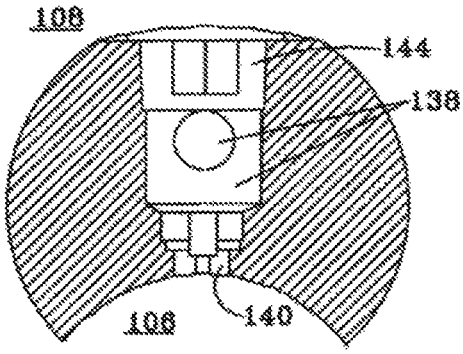
FIG. 12 sets forth a drawing illustrating a detailed blowup view of region four (4) of the B-B sectional view in FIG. 11.

FIG. 12 illustrates the detailed, blow-up view of region four (4) of FIG. 11 of the B-B sectional view in FIG. 11. FIG. 12 shows the burst disc (140) adjacent to and exposed to the interior space (106) of the tubular body. The burst disc (140) of FIG. 12 operates as a pressure barrier between the hollowed passage (138) and the interior space (106). FIG. 12 also illustrates the hollowed passage (138) used to communicate fluid pressure through the ruptured burst disc (140) to the firing head assembly in the firing assembly recess. As shown in FIG. 12, the hollowed passage (138) is blocked from the exterior space (108) by plug (144). When the pressure differential between interior space (106) and the hollowed passage (138) reaches a predetermined threshold the burst disc (140) ruptures, thereby communicating fluid pressure from the interior space (106) into the hollowed passage (138). The hollowed passage (138) includes a circular channel that extends from the portion of the hollow passage (138) containing the burst disc (140) to the firing assembly recess in the wall of the tubular body. When the predetermined level of fluid pressure reaches the firing head assembly in the firing assembly recess, the firing assembly actuates to ignite the detonation cord, which in turn detonates the perforating charges.

Figure 13:
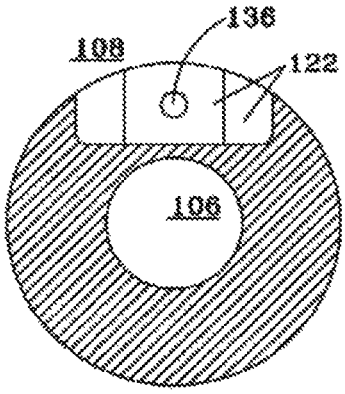
FIG. 13 sets forth a drawing illustrating a sectional view taken along the section line C-C from FIG. 5 of the wellbore subassembly with perforating gun according to the embodiments of the present disclosure.

FIG. 13 sets forth a drawing illustrating the C-C sectional view from FIG. 5 of the wellbore subassembly (100) with the perforating gun according to the embodiments of the present disclosure. FIG. 13 depicts the firing assembly recess (122)

that holds the firing head assembly. FIG. 13 also illustrates the hollowed passage (136) that connects the firing assembly recess (122) to the cavity. As described above, the detonation cord that is configured along the cavity is connected to the firing head assembly in the firing assembly recess (122) through the hollowed passage (136).

Figure 14:
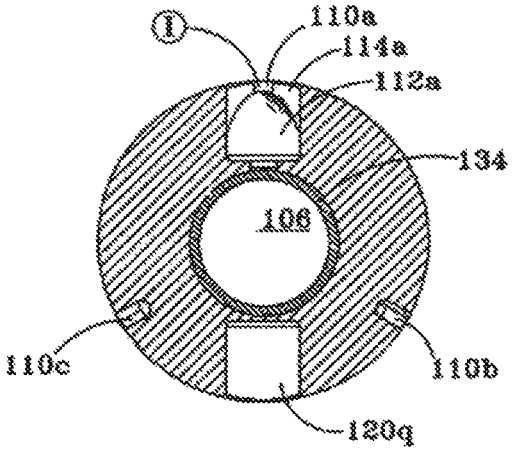
FIG. 14 sets forth a drawing illustrating a sectional view taken along the section line D-D from FIG. 5 of the wellbore subassembly with perforating gun according to the embodiments of the present disclosure.

FIG. 14 sets forth a drawing illustrating the D-D sectional view from FIG. 5 of the wellbore subassembly (100) with the perforating gun according to the embodiments of the present disclosure. FIG. 4 illustrates the relative position of the different rows of the "S" shaped cavity (110) in which the perforating charges are configured. In FIG. 14, the first row of perforating charges is contained along the portion of the cavity designated as using reference number 110*a*; the second row of perforating charges is contained along the row of the cavity designated using reference number 110*b*; and the third row of the cavity containing perforated charges is designated using reference number 110*c*. Because the perforating charges in the cavity (110) are offset from one another so that no charge lies along the same sectional plane as another perforating charge, FIG. 14 only illustrates perforating charge (112*a*) in socket (114*a*).

As described in reference to FIG. 8, the perforating charge (112*a*) in the example of FIG. 14 detonates toward the interior space (106) and through the wall (104) at the location across from the interior space (106) from the socket (114*a*), i.e., the wall target. In this manner, the perforating charge (112) detonates toward and into the interior space (106) and through exist recess (120) and into the exterior space (108). The detonation punctures the inner liner (134) as the discharge passes into and out of the interior space (106). During the detonation, however, the inner liner (134) helps to protect the other perforating charges in the other charge sockets along the tubular body from damage created by the forces generated as the perforating charge (112) detonates.

Figure 15:
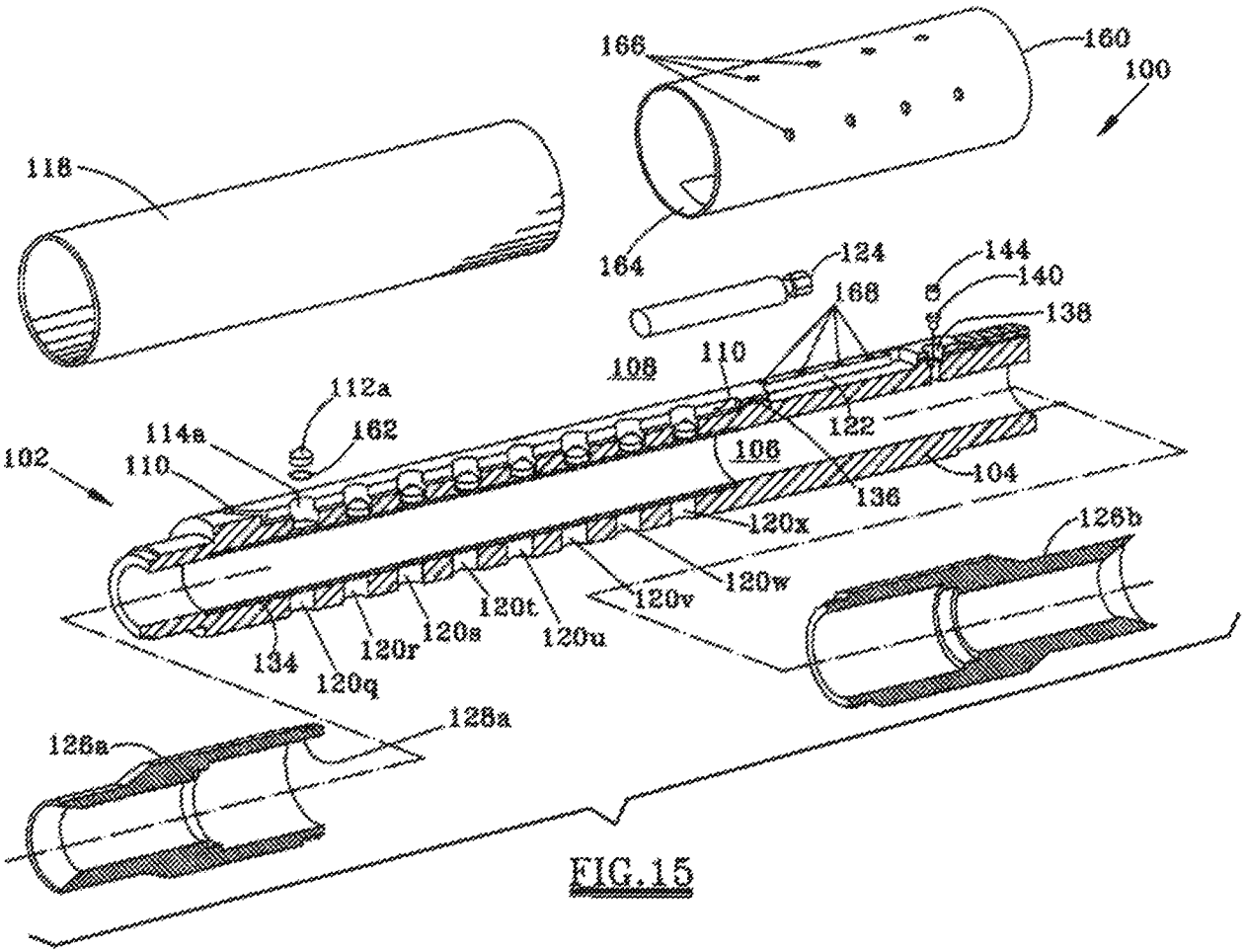
FIG. 15 sets forth a drawing illustrating an exploded view of FIG. 5 showing the wellbore subassembly with perforating gun according to the embodiments of the present disclosure.

Turning to FIG. 15, FIG. 15 sets forth a drawing illustrating an exploded view of the wellbore subassembly (100) with the perforating gun according to the embodiments of the present disclosure of FIG. 5. FIG. 15 illustrates the various components utilized in the well bore subassembly (100). The wellbore subassembly (100) of FIG. 15 includes the tubular body (102). The tubular body (102) of FIG. 15 has a wall (104) defining an interior space (106) and an exterior space (108). The wall (104) has a cavity (110) that extends longitudinally along the length of the tubular body (102) in the embodiment of FIG. 15. The cavity (110) in FIG. 15 is configured in an "S" shaped pattern through the wall (104) to form three rows of charge sockets (114) longitudinally along the length of the tubular body (102). Each charge socket (114) receives only a single perforating charge (112), and a detonation cord runs through the cavity (110) along the tops of the perforating charges (112) in the charge sockets (114) as shown in FIG. 15. In FIG. 15, the perforating charges (112) are held in place via gaskets. For example in FIG. 15, the perforating charge (112*a*) is secured in place in the socket (114*a*) using an o-ring (162).

The detonation cord that is configured along the tops of the perforating charges in the cavity (110) of FIG. 15 is ignited by a firing head assembly (124) configured in the firing assembly recess (122). The detonation cord connects to the firing head assembly (124) in the firing assembly recess (122) through a hollow passage (136) in the wall (104). In the embodiment of FIG. 15, the firing assembly (124) is configured longitudinally in the wall (104) of the tubular body (102). The firing assembly (124) is placed into the firing assembly recess (122) from the outside of the well bore subassembly (100). The firing assembly (124) of FIG. 15 is secured in place via a firing assembly sleeve (160). When installed on the tubular body (102), the firing assembly sleeve (160) of FIG. 15 rotates to expose the firing assembly recess (122) to the exterior space (108) via window (164). After the firing head assembly (124) is inserted into the firing assembly recess (122) in the embodiment of FIG. 15, the firing assembly sleeve (160) is rotated so the window (164) is toward the bottom of the tubular body (102) and the wall of the firing assembly sleeve (160) protects the firing assembly (124) from conditions in the exterior space (108). The firing assembly sleeve (160) is held in place by eight screws inserted through holes (166) when the holes (166) of the firing assembly sleeve (160) line up with holes (168) in the tubular body (102). One skilled in the art will recognize that the firing assembly sleeve (160) of FIG. 15 is for example only and not for limitation.

In the embodiment of FIG. 15, the firing assembly (124) is actuated based on a pressure signal received from the interior space (106). The firing assembly (124) of FIG. 15 operatively connects to the interior space (106) through a hollowed passage (138). The hollowed passage (138) shown in FIG. 15 is blocked from the interior space (106) by a burst disc (140). The burst disc (140) of FIG. 15 is ruptured when the pressure differential between the pressure of the interior space (106) exceeds the pressure in the hollowed passage (138) by a predetermined amount of, for example, pressure. When the predetermined pressure differential is reached, the burst disc (140) ruptures and the fluid pressure in the interior space (106) is communicated through the hollowed passage (138) to the firing assembly (124) in the recess (122). The fluid pressure from the interior space (106) is communicated to the firing assembly (124) in the recess (122) because the other open ends of the hollowed passage (138) are capped by plugs (140, 144).

Upon detonation of the firing head assembly (124), the detonation cord that extends along the cavity (110) begins igniting each perforating charge (112) in series. As each perforating charge ignites, pressure is created in the interior space (106) shown in FIG. 15. To prevent the pressure from the explosion of each charge from deforming the tubular body (102) near the cavity (110) containing the perforating charges, the tubular body (102) includes the inner liner (134). In this manner, the inner liner (134) in the embodiment shown in FIG. 15 operates to reinforce the structural integrity of the tubular body (102).

The tubular body (102), in the embodiment shown in FIG. 15 also includes a removable outer layer (118). The removable outer layer (118) of FIG. 15 is a cylindrical shell that protects the perforated charges (112) from the exterior environment (108). The removable outer layer (118) of FIG. 15 is typically installed on the wellbore subassembly (100) after the perforated charges are configured inside the charge sockets along the cavity (110).

The tubular body in the embodiment shown in FIG. 15 includes interchangeable end adapters (126*a*) and (126*b*). Theses removable end adapters (126) allow the wellbore subassembly (100) to be installed in a variety of different tubular strings. Different wellbore strings may use different threads between components in a string. The use of interchangeable end adapters (126) allows the wellbore subassembly (100) to design the middle portion of the tubular body (102) with one interface that mates with all varieties of interchangeable end adapters. For example, in FIG. 15, the threads of the middle portion of the tubular body (102) at interface (128*a*) match the threads of the of the interchangeable end adapters (126*a*), and all interchangeable end adapters may be designed with the same thread specifications as the threads at interface (128*a*). In this manner, all interchangeable end adapters are capable of connecting to the middle portion of the tubular body (102). However, the interface of the interchangeable end adapters that allow the wellbore subassembly (100) to connect with the adjacent components of a tubular string may vary in size and shape from one end adapter to another to provide a way of connecting the wellbore subassembly (100) with a variety of tubular strings. Using the interchangeable end adapters, therefore, allows for the design and manufacture of one wellbore subassembly (100), with the exception of interchangeable end adapters, that can be installed in any tubular string.

In the embodiment shown in FIG. 15, the firing assembly (124) is secured in the firing assembly recess (122) using a firing assembly sleeve (160). One skilled in the art, however, will recognize that other mechanisms for securing the firing head assembly (124) in the firing assembly recess (122) may also be useful such as, for example, using clamps.

Figure 16:
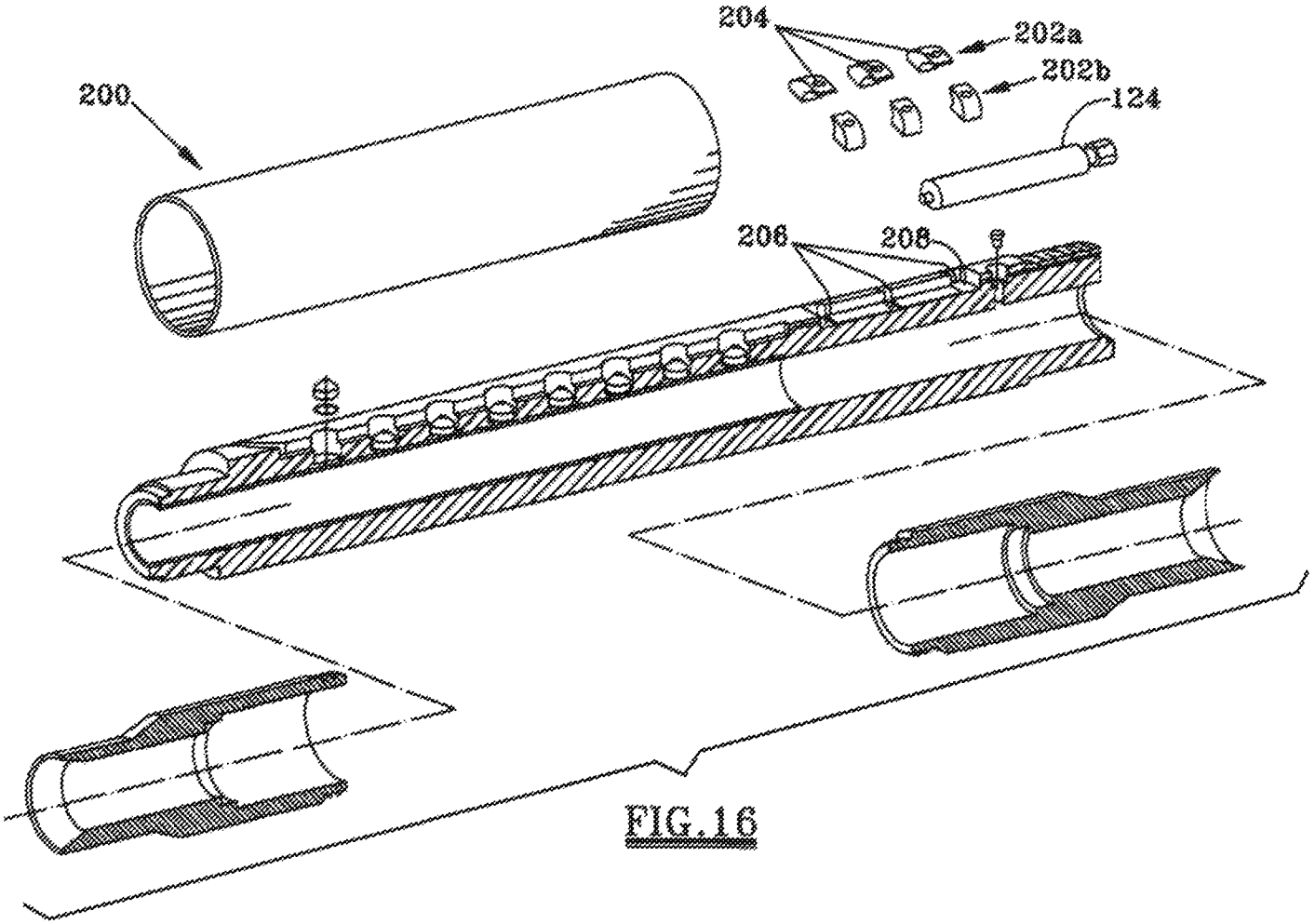
FIG. 16 sets forth an exploded view illustrating a wellbore subassembly with perforating gun according to the embodiments of the present disclosure in which the firing assembly is secured within the firing assembly recess using clamps.

Accordingly, FIG. 16 sets forth an embodiment of a wellbore subassembly (200) with perforating gun according to the embodiments of the present disclosure in which the firing assembly is secured within the firing assembly recess using one or more clamps (202). The wellbore subassembly (200) with perforating gun shown in FIG. 16 is similar to the wellbore subassembly (100) shown in FIG. 15. In the embodiment shown in FIG. 16, however, the tubular body (102) includes clamps (202) that fit into slots (206) on the tubular body (102). The clamps (202) shown in FIG. 16 are secured by screws that pass through holes (204) securing the clamps (202) in the slots (206). The firing assembly (124) of FIG. 16 is secured between the row of clamps labeled (202*a*) and the row of clamps labeled (202*b*) in the firing assembly recess (208).

Figures 17, 18, 19, 20, 21:
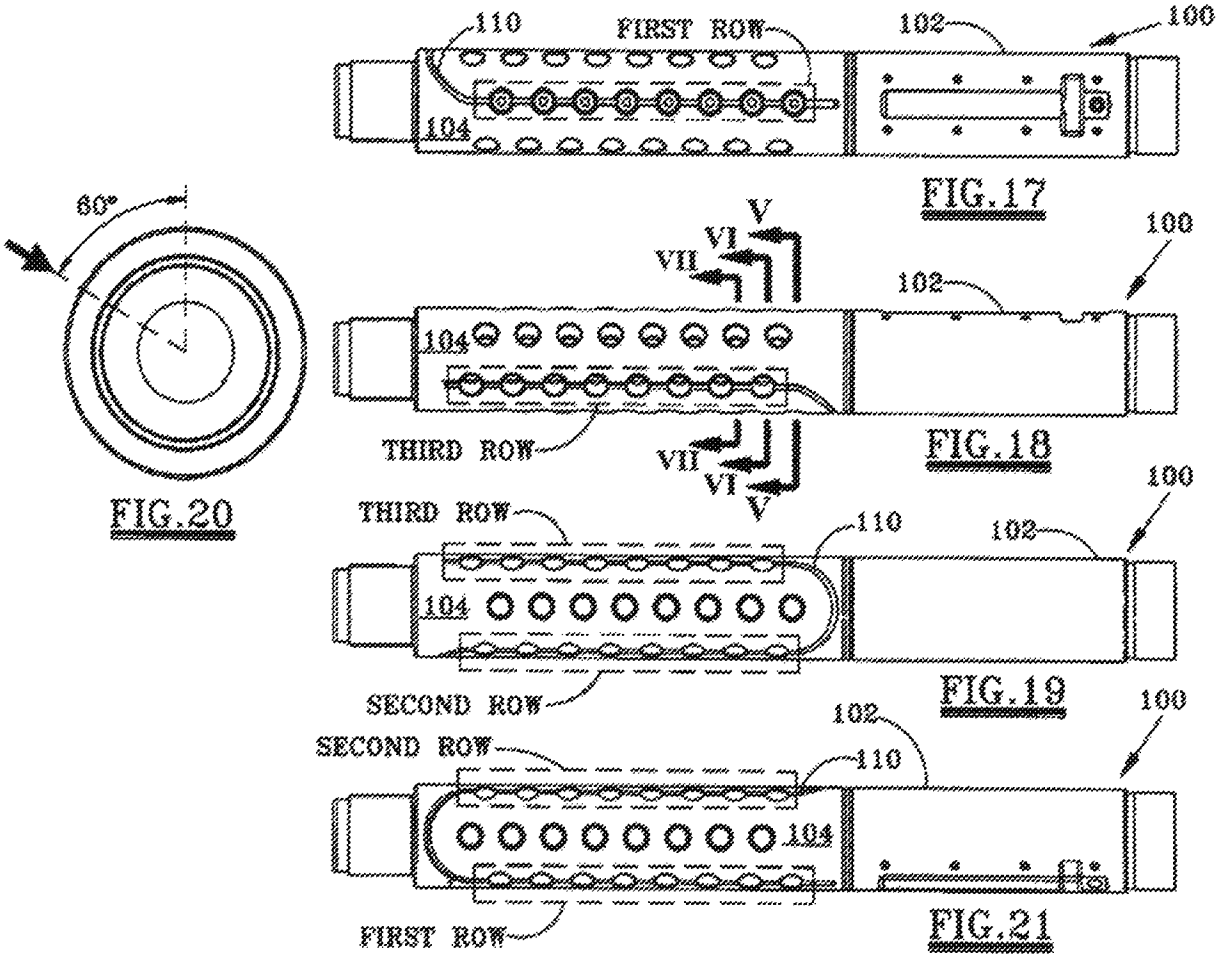
FIG. 17 sets forth a drawing illustrating a top plan view of the wellbore subassembly with a perforating gun according to the embodiments of the present disclosure without the interchangeable end adapters.
FIG. 18 sets forth a drawing illustrating the side elevation view of the wellbore subassembly with a perforating gun according to the embodiments of the present disclosure without the interchangeable end adapters.
FIG. 19 sets forth a drawing illustrating the bottom plan view of the wellbore subassembly with a perforating gun according to the embodiments of the present disclosure without the interchangeable end adapters.
FIG. 20 sets forth a drawing illustrating the section view of the wellbore subassembly with perforating gun according to the embodiments of the present disclosure without the interchangeable end adapters.
FIG. 21 sets forth a drawing illustrating another side elevation view of the wellbore subassembly with perforating gun according to the embodiments of the present disclosure without the interchangeable end adapters.

As mentioned above, the cavity in the wellbore subassembly (100) is configured using an "S" shaped pattern. FIGS. 17-21 illustrate the "S" shaped pattern of the cavity (110) in the wall of the tubular body (102) of the wellbore subassembly (100). The "S" shaped cavity (110) in FIGS. 17-21 form three rows of charge sockets. FIG. 17 sets forth a drawing illustrating a top plan view of the wellbore subassembly (100) with perforating gun according to the embodiments of the present disclosure without the interchangeable end adapters. FIG. 17 depicts the first row of the charge sockets in the "S" shaped cavity (110). The "S" shaped cavity (110) through the wall (104) as shown in FIG. 17 curves up clockwise on the left end of the tubular body (102) from the first row of the charge sockets toward the second row of the charge sockets not shown in FIG. 17.

FIG. 18 shows an elevation side view of the wellbore subassembly (100) with perforating gun according to the embodiments of the present disclosure without the interchangeable end adapters. FIG. 18 depicts the third row of charged sockets formed by the cavity (110) inside the wall (104) of the tubular body (102). In FIG. 18, the "S" shaped cavity (110) through the wall (104) curves down on the right end of the tubular body (102) toward the third row of charge sockets from the second row of charge sockets not shown in FIG. 18.

FIG. 19 sets forth a drawing illustrating the bottom view of the wellbore subassembly (100) with perforating gun according to the embodiments of the present disclosure without the interchangeable end adapters. FIG. 19 illustrates both the second and third rows of the charge sockets formed by the cavity (110) inside the wall (104) of the tubular body (102). In FIG. 49, the "S" shaped cavity (110) through the wall (104) curves up clockwise on the left end of the tubular body (102) and extends toward the right end of the tubular body (102) to form the second row of charge sockets. The "S" shaped cavity (110) then curves up counter-clockwise on the right end of the tubular body (102) and extends toward the left end of the tubular body (102) to form the third row of charge sockets.

FIG. 20 sets forth a drawing illustrating a cross-sectional view of the wellbore subassembly (100) with perforating gun according to the embodiments of the present disclosure without the interchangeable end adapters. FIG. 20 includes a directional arrow identified in FIG. 20 as the "path view." The path view is essentially the top view of the wellbore subassembly (100) rotated sixty degrees (60°) to provide a view that includes both the first and second row of charge sockets.

FIG. 21 sets forth a drawing illustrating the path view the wellbore subassembly (100) with perforating gun according to the embodiments of the present disclosure without the interchangeable end adapters. FIG. 21 depicts the first and second rows of the charge sockets formed by the cavity (110) inside the wall (104) of the tubular body (102). In FIG. 21, the "S" shaped cavity (110) begins at the right end of the tubular body (102) and extends toward the left end of the tubular body (102) to form the first row of charge sockets. The "S" shaped cavity (110) then curves up clockwise on the left end of the tubular body (102) and extends toward the right end of the tubular body (102) to form the second row of charge sockets. The "S" shaped cavity (110) then curves up counter-clockwise on the right end of the tubular body (102) toward the third row of charge sockets not shown in FIG. 21.

Figure 22:
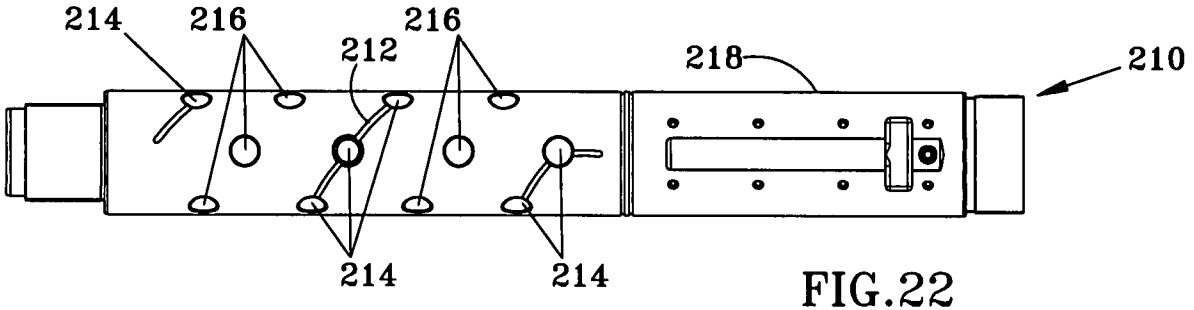
FIG. 22 sets forth a drawing illustrating a top plan view of an additional wellbore subassembly with perforating gun according to embodiments of the present disclosure.

While FIGS. 17-21 illustrate a cavity configured in an "S" shaped pattern within the wall of the wellbore subassembly with perforating gun according to embodiments of the present disclosure, the cavity may be configured in other ways as will occur to those of skill in the art. Consider, for example, the cavity of FIGS. 22 and 23. FIG. 22 sets forth a drawing illustrating a top orthogonal view of a wellbore subassembly (210) with perforating gun according to embodiments of the present disclosure. In FIG. 22, the removable outer layer is not shown in order to expose the cavity (212). The cavity (212) of FIG. 22 is configured in a spiral pattern within and along the wall of the tubular body (218). In the example of FIG. 22, the cavity (212) is shaped to define the charge sockets (214), and each charge socket (214) receives only a single perforating charge. In the example of FIG. 22, the tubular body (218) also includes exit cavities (216). Similar to the charge sockets (214), these exit cavities (216) of FIG. 22 are also configured in a spiral pattern longitudinally along the tubular body (218).

Figure 23:
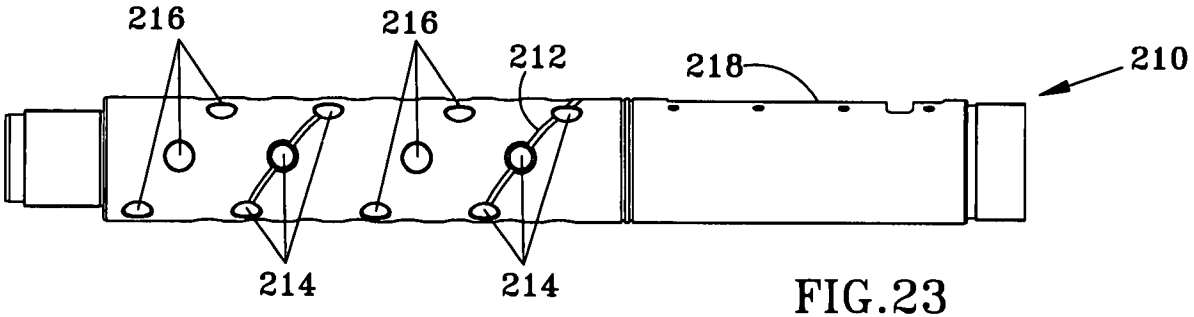
FIG. 23 sets forth a drawing illustrating a side elevation view of the additional wellbore subassembly with perforating gun according to embodiments of the present disclosure.

FIG. 23 sets forth a drawing illustrating an elevation view of the wellbore subassembly (210) with perforating gun according to embodiments of the present disclosure. The view of FIG. 23 depicts certain portions of the cavity (212) and certain exit cavities (216) that are not visible in FIG. 22. That is, FIG. 23 continues to illustrate the spiral shaped pattern formed from the cavity (212) and the sockets (212), as well as the exit cavities (216). One of skill in the art will note that the "S" shaped and spiral shaped cavities described herein are for explanation only, not for limitation. A wellbore subassembly according to embodiments of the present disclosure may utilize cavities shaped in any pattern as will occur to those of skill in the art. Further, one of skill in the art will note that, while the exemplary wellbore assemblies according to embodiments of the present disclosure described herein utilize only a single cavity to form the "S" shaped pattern or the spiral pattern, this is for explanation only and not for limitation. In fact, a wellbore subassembly according to embodiments of the present disclosure may utilize any number of cavities.

Figure 24:
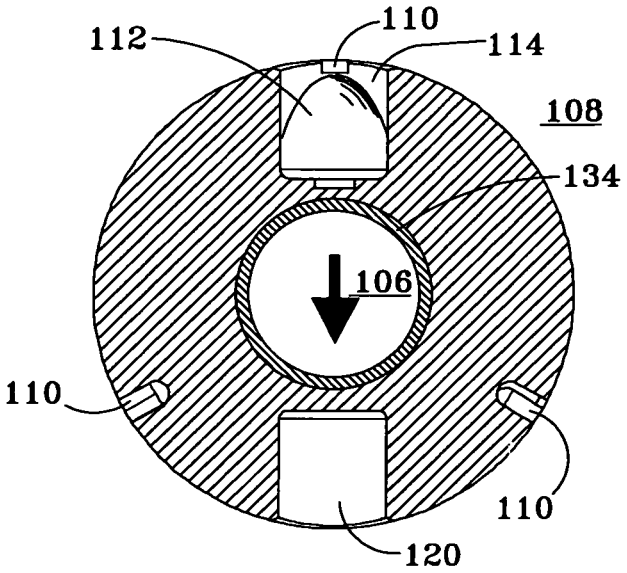
FIG. 24 sets forth a drawing illustrating the E-E sectional view from FIG. 18 of the wellbore subassembly with a perforating gun according to the embodiments of the present disclosure.
Figure 25:
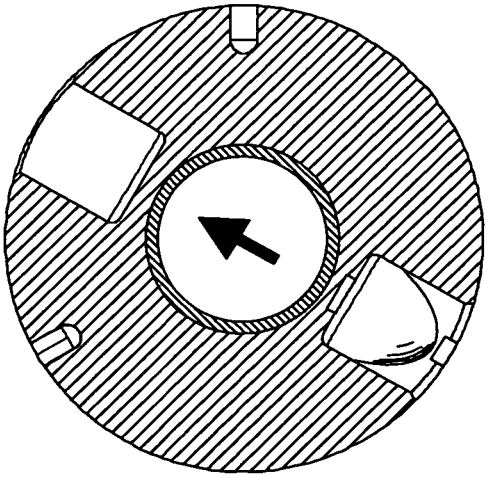
FIG. 25 sets forth a drawing illustrating the F-F sectional view from FIG. 18 of the wellbore subassembly with perforating gun according to the embodiments of the present disclosure.
Figure 26:
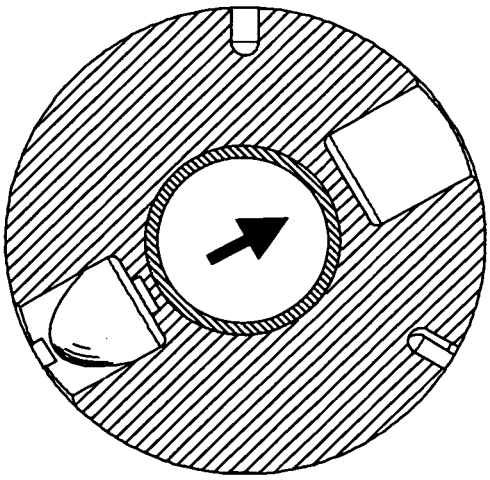
FIG. 26 sets forth a drawing illustrating the G-G sectional view from FIG. 18 of the wellbore subassembly with perforating gun according to the embodiments of the present disclosure.

FIGS. 24 through 26 show cross sections of the tubular body (102) of the wellbore subassembly (100) of FIG. 18. FIG. 24 sets forth a drawing illustrating the 24-24 sectional view from FIG. 18 of the wellbore subassembly (100) with perforating gun according to the embodiments of the present disclosure. FIG. 24 depicts a perforating charge (112) configured in the charge socket (114) from the first row of charge sockets in cavity (110). The perforating charge (112) discharges toward the interior space (106) through the inner liner (134) and penetrates into the exterior space (108) through the inner liner (134) and the exit recess (120) by perforating the wall (104) across the interior space (106) from the location of the perforating charge (112). In perforating the wall (104) across the interior space (106) from the location of the perforating charge (112), the discharge from the perforating charge (112) punctures the inner liner (134) as it passes through the exit recess (120) into the exterior space (108). In this manner, the perforating charge (112) in FIG. 24 discharges along the arrow shown in FIG. 24.

As noted above with reference to FIG. 18, FIG. 24 does not depict the removable outer layer (118). The removable outer layer secures the perforating charge (112) in the socket (114) and protects the perforating charge (112) from conditions in the exterior space (108). Upon discharge, the perforating charge (112) also punctures the removable outer layer at the location of the exit recess (120).

FIG. 25 sets forth a drawing illustrating the F-F sectional view from FIG. 18 of the wellbore subassembly (100) with perforating gun according to the embodiments of the present disclosure. FIG. 25 depicts a perforating charge (112) in a charge socket (114) formed in the second row of the cavity (110). Similar to the perforating charge (112) in FIG. 24, the perforating charge in FIG. 25 is configured to discharge toward the interior space and penetrate into the exterior space by perforating the wall across from the interior space from the location of the perforating charge (112). That is, the perforating charge in FIG. 25 discharges along the arrow shown in FIG. 25 through the inner liner (134), the exit cavity (120), and the removable outer layer (not shown).

FIG. 26 sets forth a drawing illustrating the G-G sectional view from FIG. 18 of the wellbore subassembly (100) with perforating gun according to the embodiments of the present disclosure. FIG. 26 depicts a perforating charge (112) in a charge socket (114) formed in the third row of the cavity (110). Similar to the perforating charge (112) in FIG. 24, the perforating charge in FIG. 26 is configured to discharge toward the interior space and penetrate into the exterior space by perforating the wall across from the interior space from location of the perforating charge (112). That is, the perforating charge in FIG. 26 discharges along the arrow shown in FIG. 26 through the inner liner (134), the exit cavity (120), and the removable outer layer (not shown).

FIGS. 24-26 illustrate the exit cavities (120) corresponding to the charge sockets (114). The exit cavity (120) can have therein or associated therewith an accelerator or performance enhancer to provide a cleaner perforation tunnel, as well as a longer, bigger and better defined fraction or perforation. The accelerator or performance enhancer can be any appropriate stimulator, such as for example, a jet fuel product. Further, the accelerator or per enhancer can be in any for, such as for example, a solid, liquid, wax or combinations thereof. Such an accelerator or performance enhancer can be built into the exit cavity (120), can be placed in the exit cavity (120), or associated with the exit cavity (120) so as provide a cleaner perforation tunnel, as well as a longer, bigger and better defined fracture or perforation.

It has been found that the configuration of the charge socket (114), the interior space (106) and the exit cavity (120) creates a focused discharge that greatly enhances the resulting explosive characteristics. There is a volume of gas and air that expands when the charges (112) ignite. This natural expansion of gas and air provides additional explosive characteristics.

Further, it has been found that the structure and/or configuration of the charge socket (114) enhances the explosive characteristics associated with the present disclosure. The structure and/or configuration of the charge socket (114) confines the explosive charge characteristics thereby increasing the charge performance.

Figure 27:
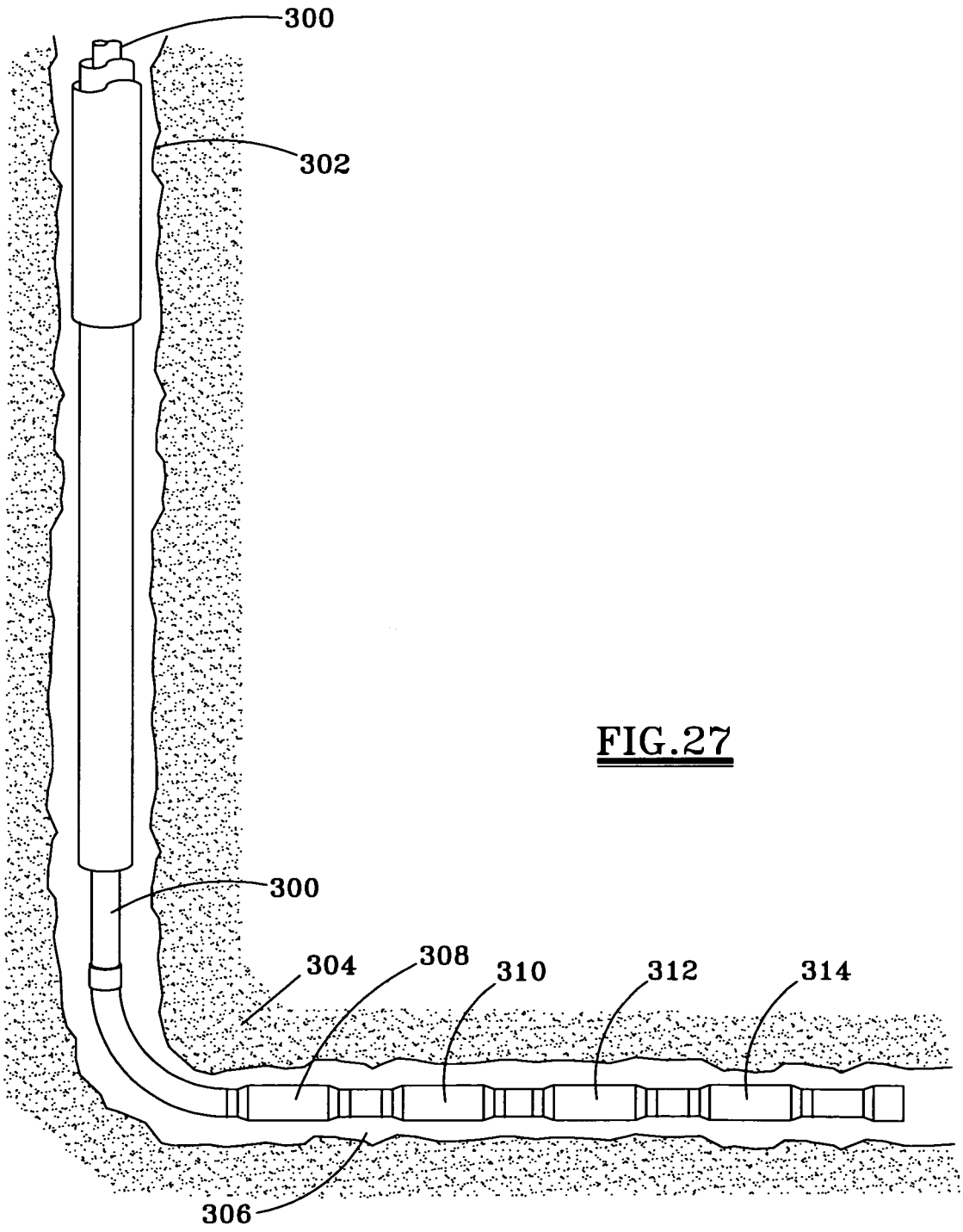
FIG. 27 sets forth a drawing illustrating several wellbore subassemblies with perforating guns according to the embodiments of the present disclosure that are conveyed along a casing string of a horizontal well.

As previously mentioned, the wellbore subassembly with perforating gun according to the embodiments of the present disclosure is conveyed through a wellbore as part of a tubular string. For further explanation, FIG. 27 sets forth a drawing illustrating several wellbore subassemblies (308, 310, 312, 314) with perforating guns according to the embodiments of the present disclosure that are conveyed along a casing string of a horizontal well. FIG. 27 depicts a casing string (300) conveyed through a bore hole (302) that penetrates and turns through a geological formation (304). In the example of FIG. 27, the casing string (300) is secured in the bore hole (302) using cement (306), which is optional. The casing string (300) in FIG. 27 includes four wellbore subassemblies (308, 310, 312, 314) with perforating guns according to the embodiments of the present disclosure. The perforating charges in the each of the wellbore subassemblies (308, 310, 312, 314) may be detonated individually or concurrently together in a group or in any desired combination. Upon detonation of the perforating charges in one of the wellbore subassemblies (308, 310, 312, 314), the perforating charges puncture the optional concrete (306) annulus surrounding the casing string (300) and penetrate into the formation (304) at a point adjacent to the respective wellbore subassembly. After the perforations have been created in the formation (304), fracing or other completion processes may be used to prepare the well for extraction of hydrocarbons in the adjacent areas of the formation (304).

The arcuate and lateral portions of the borehole (302) create specific problems, especially with respect to perforating. However, these problems are resolved with the use of the apparatus and methods of the present disclosure. Further, the longer the lateral portions of the borehole (302), the more difficult it is to achieve effective perforations. Not so with the use of the apparatus and methods of the present disclosure. Thus, as drilling practices are directed more toward directional drilling, and directional drilling creates more and longer lateral well bores, the need for the effective perforating techniques as defined in the present disclosure increase.

Figure 28:
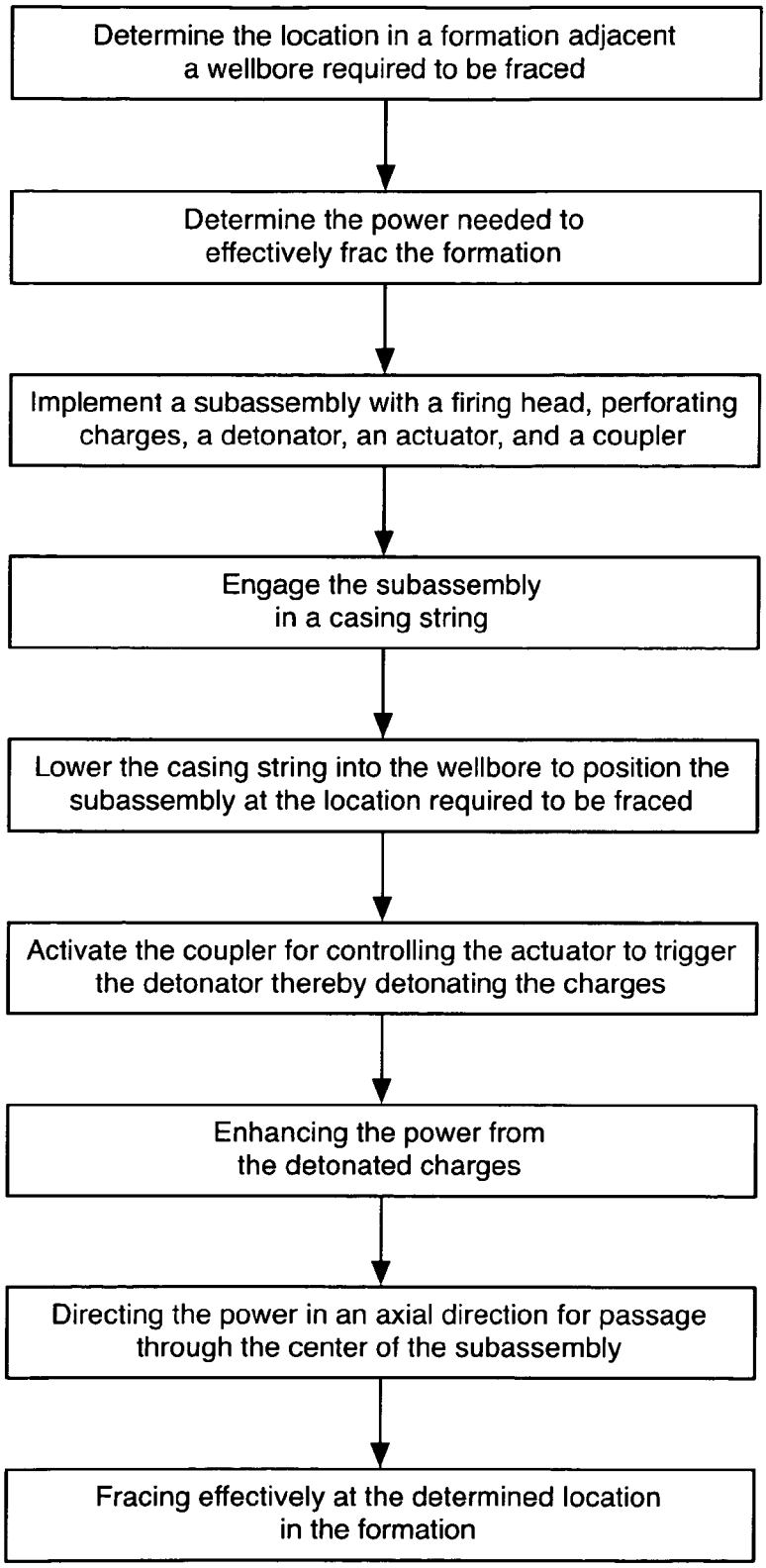
FIG. 28 is a flow chart of a method of using the present disclosure.

FIG. 28 is a flow chart of a method of using the present disclosure. The method comprises the following steps. Determining the location in a formation adjacent a wellbore required to be fraced, and determining the power needed to effectively frac the formation. Implement a subassembly with a firing head, perforating charges, a detonator, an actuator, and a coupler by engaging the subassembly in a casing string. Lower the casing string into the wellbore to position the subassembly at the location required to be fraced. Activate the coupler for controlling the actuator to trigger the detonator thereby detonating the charges. Enhancing the power with respect to the detonated charges. Directing the power in an axial direction for passage through the center of the subassembly. And, fracing effectively at the determined location in the formation.

In another embodiment, a method for using a firing assembly with a wellbore subassembly having a perforating gun is provided. The method comprises the following steps. Providing a firing assembly having a detonator, an actuation chamber, a moveable actuator in the actuation chamber, and a coupler. The moveable actuator is operatively connected to the detonator and the coupler on opposite ends of the actuator. The coupler is moveable relative to the other portions of the firing assembly to adjust the length of the firing assembly from a shortest length to a longest length. Providing a wellbore subassembly having a perforating charge. The wellbore subassembly comprises a tubular wall having a firing assembly receptacle configured longitudinally along the length of the wellbore subassembly. The firing assembly receptacle has a length that is larger than the shortest length and is shorter than the longest length of the firing assembly. The firing assembly is inserted into the firing assembly receptacle, and the coupler is adjusted to increase the length of the firing assembly until frictional and compression forces secure the firing assembly in the firing assembly receptacle.

In yet another embodiment, a method for using a firing assembly with a wellbore subassembly having a perforating gun is provided. The method comprises the following steps. A firing assembly comprises retaining a movable actuator in a first position in an actuation chamber. A firing assembly is used with a wellbore subassembly having a perforating gun. An activation signal is received in the firing assembly through the tubular wall and the coupler. In response to the receiving of the activation signal, the actuator is repositioned to a second position. In response to moving the actuator to the second position, the perforating charge is detonated.

The perforating apparatus and methods defined in this disclosure provide enhanced perforating techniques and characteristics because of the structure of the apparatus and the methodology associated therewith. The present perforating apparatus and methods do not require secondary control lines that extend to the surface, and are easy to install and use. The present perforating apparatus and methods result in a truly "disappearing" perforating gun that is unobtrusive after it has been used.

The characteristics of the perforation achieved by the present disclosure are greatly enhanced. Particularly, the achievement of a continuous, normal perforation, free from disruption, has been achieved. The perforating apparatus and methods defined in this disclosure use existing charges to enhance the capacity and forcefulness of the perforation. Still further, the present perforating apparatus and methods reduce the costs, are less time consuming, reduce the manpower needs and is significantly less prone to safety problems. Specifically, the systems and apparatus described allow operators at the surface of the well to quickly and safely insert the firing assembly into the wall of the wellbore subassembly without the need to perform extensive assembly of the perforating gun to install the detonators.

While certain exemplary embodiments have been described in details and shown in the accompanying drawings, it is to be understood that such embodiments are merely illustrative of and not devised without departing from the basic scope thereof, which is determined by the claims that follow.

We claim:

1. A firing assembly for detonating charges of a perforating gun, the firing assembly comprising: one or more casings connected together to form a containment body configured to fit within a recess formed within a tubular wall of well bore subassembly effective to operate without obtruding on fluid flow within the central core of the subassembly; the containment body comprising a detonation chamber and an actuation chamber; a detonator configured in the detonation chamber; a moveable actuator configured in the actuation chamber and operatively connected to the detonator, wherein the actuator is retained in a first position in the actuation chamber by a retention detent; a coupler operatively connected to the actuator opposite the detonator, wherein the coupler comprises a channel for communicating pressure through the coupler to the actuator effective to overcome the retention detent and to allow the actuator to move in the actuation chamber to a second position, wherein the actuator contacts the detonator in the second position, effective to activate the detonator.

2. The firing assembly of claim 1 wherein the casing adjacent the detonator opposite the actuator comprises a channel configured to contain a detonation cord connectable to one or more perforating charges mounted inside a wellbore subassembly conveyed along a tubular string connected to the easing.

3. The firing assembly of claim 1 wherein the channel through the coupler is connected to the interior space of a wellbore subassembly effective to receive an activating pressure from said interior space.

4. The firing assembly of claim 1 wherein a portion of the coupler is configured inside the containment body and a remaining portion of the coupler is configured outside the containment body.

5. The firing assembly of claim 1 wherein the coupler is movable relative to the containment body and moving the coupler adjusts the length of the firing assembly to secure the firing assembly in a tubular wall of a wellbore subassembly.

6. The firing assembly of claim 1 wherein the coupler is integrated into the containment body.

7. The firing assembly of claim 1 further comprising a threaded interface between the coupler and the containment body, wherein the coupler rotates relative to the containment body to adjust the length of the firing assembly.

8. The firing assembly of claim 1 whereto the moveable actuator is a movable piston in the actuating chamber; and the retention detent comprises one or more shear pins that shear when the pressure communicated through the coupler reaches as predetermined threshold pressure.

9. The firing assembly of claim 1 wherein the moveable actuator is operatively connected to the detonator using a firing pin.

10. The firing assembly of claim 1 wherein the actuation chamber contains fluid; the moveable actuator is operatively connected to the detonator via the fluid; and the detonator activates in dependence upon fluid pressure communicated via the fluid to the detonator as the actuator moves to the second position.

* * * * *